US010472189B2

(12) United States Patent
Kajiki

(10) Patent No.: US 10,472,189 B2
(45) Date of Patent: Nov. 12, 2019

(54) SHEET MATERIAL TAKE-IN APPARATUS, SHEET MATERIAL CONVEYING APPARATUS, IMAGE READING APPARATUS, AND IMAGE FORMING APPARATUS

(71) Applicant: CANON DENSHI KABUSHIKI KAISHA, Chichibu-shi, Saitama-ken (JP)

(72) Inventor: Koichi Kajiki, Tokyo (JP)

(73) Assignee: Canon Denshi Kabushiki Kaisha, Chichibu-shi (JP)

( * ) Notice: Subject to any disclaimer, the term of this patent is extended or adjusted under 35 U.S.C. 154(b) by 0 days.

(21) Appl. No.: 15/910,431

(22) Filed: Mar. 2, 2018

(65) Prior Publication Data

US 2018/0186592 A1 Jul. 5, 2018

Related U.S. Application Data

(63) Continuation of application No. 15/373,665, filed on Dec. 9, 2016, now Pat. No. 9,944,486, which is a (Continued)

(30) Foreign Application Priority Data

Dec. 17, 2012 (JP) ..... 2012-275070

(51) Int. Cl.
*B65H 3/02* (2006.01)
*B65H 3/06* (2006.01)

(Continued)

(52) U.S. Cl.
CPC ..... *B65H 3/02* (2013.01); *B65H 1/025* (2013.01); *B65H 3/06* (2013.01); *B65H 3/0653* (2013.01);

(Continued)

(58) Field of Classification Search
CPC ..... B65H 3/02; B65H 3/06; B65H 3/0607; B65H 3/063; B65H 3/54; B65H 7/00; B65H 7/02; B65H 83/02
See application file for complete search history.

(56) References Cited

U.S. PATENT DOCUMENTS 5,431,383 A 7/1995 Fujimoto et al.
5,552,859 A 9/1996 Nakagawa et al.

(Continued)

FOREIGN PATENT DOCUMENTS

CN 1156118 A 8/1997
CN 1523455 A 8/2004

(Continued)

OTHER PUBLICATIONS

Chinese Office Action issued in Chinese Application No. 201380070712.4 dated Feb. 26, 2016.

(Continued)

*Primary Examiner* — David H Bollinger
(74) *Attorney, Agent, or Firm* — Venable LLP

(57) ABSTRACT

User labor relating to determining on an alignment condition is reduced and a stable conveying operation is realized by aligning a sheet bundle also when a sheet bundle is added. A sheet bundle composed of multiple sheet materials is placed on a loading platform. An encoder pulse unit detects the amount of the sheet bundle placed on the loading platform based on the opening amount of a pressure plate. A control unit determines on an alignment condition according to the amount of the sheet bundle. Rotating members align the sheet bundle in accordance with the alignment condition. When it is determined that another sheet bundle has been added to the loading platform, the control unit updates the (Continued)

alignment condition according to the total amount of the other sheet bundle and the sheet bundle remaining on the loading platform.

20 Claims, 18 Drawing Sheets

Related U.S. Application Data continuation of application No. 14/734,309, filed on Jun. 9, 2015, now Pat. No. 9,555,995, which is a continuation of application No. PCT/JP2013/007379, filed on Dec. 16, 2013.

(51) Int. Cl.
*B65H 3/62* (2006.01)
*B65H 1/02* (2006.01)
*B65H 7/02* (2006.01)

(52) U.S. Cl.
CPC ..... *B65H 3/62* (2013.01); *B65H 7/02* (2013.01); *B65H 2301/4222* (2013.01); *B65H 2404/1116* (2013.01); *B65H 2405/3322* (2013.01); *B65H 2511/212* (2013.01); *B65H 2511/30* (2013.01); *B65H 2511/414* (2013.01); *B65H 2513/512* (2013.01); *B65H 2513/514* (2013.01); *B65H 2801/39* (2013.01)

(56) References Cited

U.S. PATENT DOCUMENTS

| | | | |
|---|---|---|---|
| 5,863,036 | A | 1/1999 | Tanaka et al. |
| 6,179,550 | B1 | 1/2001 | Schuster et al. |
| 6,508,465 | B1 | 1/2003 | Endo |
| 7,025,347 | B2 | 4/2006 | Masui et al. |
| 7,270,326 | B2 | 9/2007 | Mitsuya et al. |
| 7,364,155 | B2 | 4/2008 | Nagao et al. |
| 7,416,180 | B2 | 8/2008 | Mitsuya et al. |
| 7,717,416 | B2 | 5/2010 | Mitsuya et al. |
| 7,891,654 | B2 | 2/2011 | Izumichi |
| 8,118,297 | B2 | 2/2012 | Izumichi |
| 2004/0051232 | A1 | 3/2004 | Masui et al. |
| 2004/0212139 | A1 | 10/2004 | Nagao et al. |
| 2014/0374948 | A1 | 12/2014 | Vincent et al. |
| 2015/0336759 | A1 | 11/2015 | Tsuyuki et al. |

FOREIGN PATENT DOCUMENTS

| | | | |
|---|---|---|---|
| CN | 1590259 | A | 3/2005 |
| CN | 1321046 | C | 6/2007 |
| CN | 101734500 | A | 6/2010 |
| JP | 03-223044 | A | 10/1991 |
| JP | 06-271118 | A | 9/1994 |
| JP | 10-181919 | A | 7/1998 |
| JP | 2004-131290 | A | 4/2004 |
| JP | 2004-238161 | A | 8/2004 |
| JP | 2004-338835 | A | 12/2004 |
| JP | 2005-239383 | A | 9/2005 |
| JP | 2008-050144 | A | 3/2008 |
| WO | 98/49082 | A2 | 11/1998 |

OTHER PUBLICATIONS

Supplementary Partial European Search Report issued in European Patent Application No. 13865444.7 dated Mar. 22, 2017.

Japanese Office Action issued in Japanese Application No. 2016-256654 dated Sep. 19, 2017.

Office Action dated Jun. 4, 2018, in Chinese Patent Application No. 201710587969.7.

SHEET MATERIAL TAKE-IN APPARATUS, SHEET MATERIAL CONVEYING APPARATUS, IMAGE READING APPARATUS, AND IMAGE FORMING APPARATUS

This application is a continuation of is a continuation of U.S. patent application Ser. No. 15/373,665, filed Dec. 9, 2016, which is a continuation of U.S. patent application Ser. No. 14/734,309, filed Jun. 9, 2015, which is a continuation of International Patent Application No. PCT/JP2013/007379 filed on Dec. 16, 2013, and claims priority to Japanese Patent Application No. 2012-275070 filed Dec. 17, 2012, the entire content of both all of which is incorporated herein by reference.

BACKGROUND OF THE INVENTION

Field of the Invention

The present invention relates to a sheet material take-in apparatus that takes in a sheet material, a sheet material conveying apparatus that conveys a sheet material, and an image reading apparatus and an image forming apparatus including a sheet material take-in apparatus and a sheet material conveying apparatus.

Description of the Related Art

According to Patent Documents 1 and 2, sheet material conveying apparatuses have been proposed in which a sheet bundle composed of multiple sheet materials is placed on a loading platform in a standing state in which the overlapping direction of the sheet materials is approximately horizontal, and in this state, the sheet materials are conveyed one by one on a conveyance path.

According to Patent Document 1, a sheet bundle placed on the loading platform is vibrated by the entirety of a bottom plate vibrating, whereby the end portions in the sheet material conveyance direction of the sheet bundle are aligned. Accordingly, paper supply failure, jamming after paper supply, oblique traveling of sheet materials, and the like are prevented.

According to Patent Document 2, it is proposed that the end portions of the sheet bundle are aligned by providing at least a cam-shaped rotating member of the sheet loading platform and causing the cam-shaped rotating member to rotate. Furthermore, according to Patent Document 2, it is proposed that a sheet material stacking amount is obtained by detecting the holding position of a pressure plate that presses the sheet bundle, and the operation time for document end alignment and the number of instances, speed, and amplitude of vibrating the vibration member are automatically set according to the sheet material stacking amount.

Patent Document 1: Japanese Patent Laid-Open No. 3-223044

Patent Document 2: Japanese Patent Laid-Open No. 2004-131290, paragraphs 0068 and 0072

The invention disclosed in Patent Document 2 is advantageous in that the burden on the user is lightened since the operation time for document end alignment is set automatically. However, if a sheet bundle is added during conveyance, various problems occur. The added sheet bundle has not yet been aligned. That means that there may be sideways or misaligned sheet materials in the sheet bundle. When these kinds of sheet materials are conveyed, the sheet materials are damaged due to jamming, multiple sheet materials are conveyed at the same time, and accurate reading of magnetic ink characters is impeded.

Note that there is a risk that the above-described problems will occur in a similar manner in the case where another sheet is added later to the sheet bundle on the loading platform, regardless of the orientation of the sheet bundle during take-in (e.g., upright placement, horizontal placement, and the like). Also, the present invention is not limited to the above-described background art.

It is a feature of the present invention to realize a stable feeding operation or conveying operation by aligning an added sheet bundle while lightening user labor regarding determining on the alignment condition and the subsequent processing also when a sheet bundle is added.

SUMMARY OF THE INVENTION

The present invention provides a sheet material take-in apparatus including, for example, an apparatus body having a loading platform on which a sheet bundle composed of a plurality of sheet materials is loaded, take-in unit configured to take in a sheet material from the loading platform to the interior of the apparatus body, pressing unit configured to press a sheet bundle to the take-in unit on the loading platform, aligning unit configured to align a sheet bundle loaded on the loading platform, and control unit configured to control an operation of the aligning unit, wherein the control unit controls the operation of the aligning unit based on an amount of change in the pressing position of the sheet material pressed by the pressing unit.

Also, the present invention provides a sheet material take-in apparatus including an apparatus body having a loading platform on which a sheet bundle composed of a plurality of sheet materials is loaded, take-in unit configured to take in a sheet material from the loading platform into the apparatus body, pressing unit configured to press a sheet bundle on the loading platform to the take-in unit, aligning unit configured to align a sheet bundle placed on the loading platform, an operation unit that is provided in the apparatus body and is configured to start an operation of the aligning unit, and control unit configured to control the operation of the aligning unit, wherein the control unit controls the operation of the aligning unit based on the pressing position of the sheet material pressed by the pressing unit when the operation unit is operating.

Furthermore, the present invention provides a sheet material conveying apparatus including a loading platform on which a sheet bundle composed of a plurality of sheet materials is loaded, detecting unit configured to detect an amount of a sheet bundle loaded on the loading platform, determining unit configured to determine on an alignment condition according to the amount of the sheet bundle detected by the detecting unit, aligning unit configured to align the sheet bundle loaded on the loading platform in accordance with the alignment condition determined on by the determining unit, conveying unit configured to conveying a sheet material of the sheet bundle, determining unit configured to determine whether or not another sheet bundle has been added to the loading platform based on the amount of the sheet bundle detected by the detecting unit, and updating unit configured to, when the determining unit determines that another sheet bundle has been added to the loading platform, update the alignment condition according to the total amount of the other sheet bundle and the sheet bundle remaining on the loading platform.

Also, the present invention provides a sheet material take-in apparatus that includes a loading platform on which a sheet bundle composed of a plurality of sheet materials is loaded, take-in unit configured to take in a sheet material from the loading platform to the interior of the apparatus body, aligning unit configured to align the sheet bundle placed on the loading platform, and control unit configured to control an operation of the aligning unit, wherein the control unit controls the operation of the aligning unit based on addition of a sheet to the loading platform.

Furthermore, the present invention is not limited to the above-described sheet material take-in apparatus and provides a sheet material take-in apparatus that includes, for example, a loading platform on which a sheet bundle composed of a plurality of sheet materials is loaded, take-in unit configured to take in a sheet material from the loading platform to the interior of the apparatus body, and control unit configured to control an operation of the take-in unit, wherein the control unit controls the operation of the take-in unit based on addition of a sheet to the loading platform.

According to the present invention, when the sheet material take-in apparatus or the sheet material conveying apparatus detects the addition of a sheet bundle, for example, during feeding or conveyance, the sheet material take-in apparatus or the sheet material conveying apparatus updates an alignment condition of the sheet bundle and aligns the added sheet bundle. Alternatively, an operation of taking in a sheet is controlled based on the addition of the sheet. Accordingly, user labor relating to determining on the alignment condition is lightened, and it is possible to realize a stable feeding operation or conveying operation by aligning the added sheet bundle.

Further features and advantages of the present invention will become apparent from the follow description with reference to the accompanying drawings. Note that in the accompanying drawings, configurations that are the same or similar are denoted by the same reference numerals.

BRIEF DESCRIPTION OF THE DRAWINGS

The attached drawings are included in the specification and constitute part thereof, showing embodiments of the present invention, and being used for illustrating the spirit of the present invention together with the description of the embodiments.

DESCRIPTION OF THE EMBODIMENTS

Hereinafter, exemplary embodiments of the present invention will be described in detail with reference to the drawings. Note that unless it is specifically stated otherwise, the dimensions, materials, shapes, relative positions, and the like of the components described in the embodiments are not intended to limit the claims of the present invention.

Embodiment 1

Figure 1:
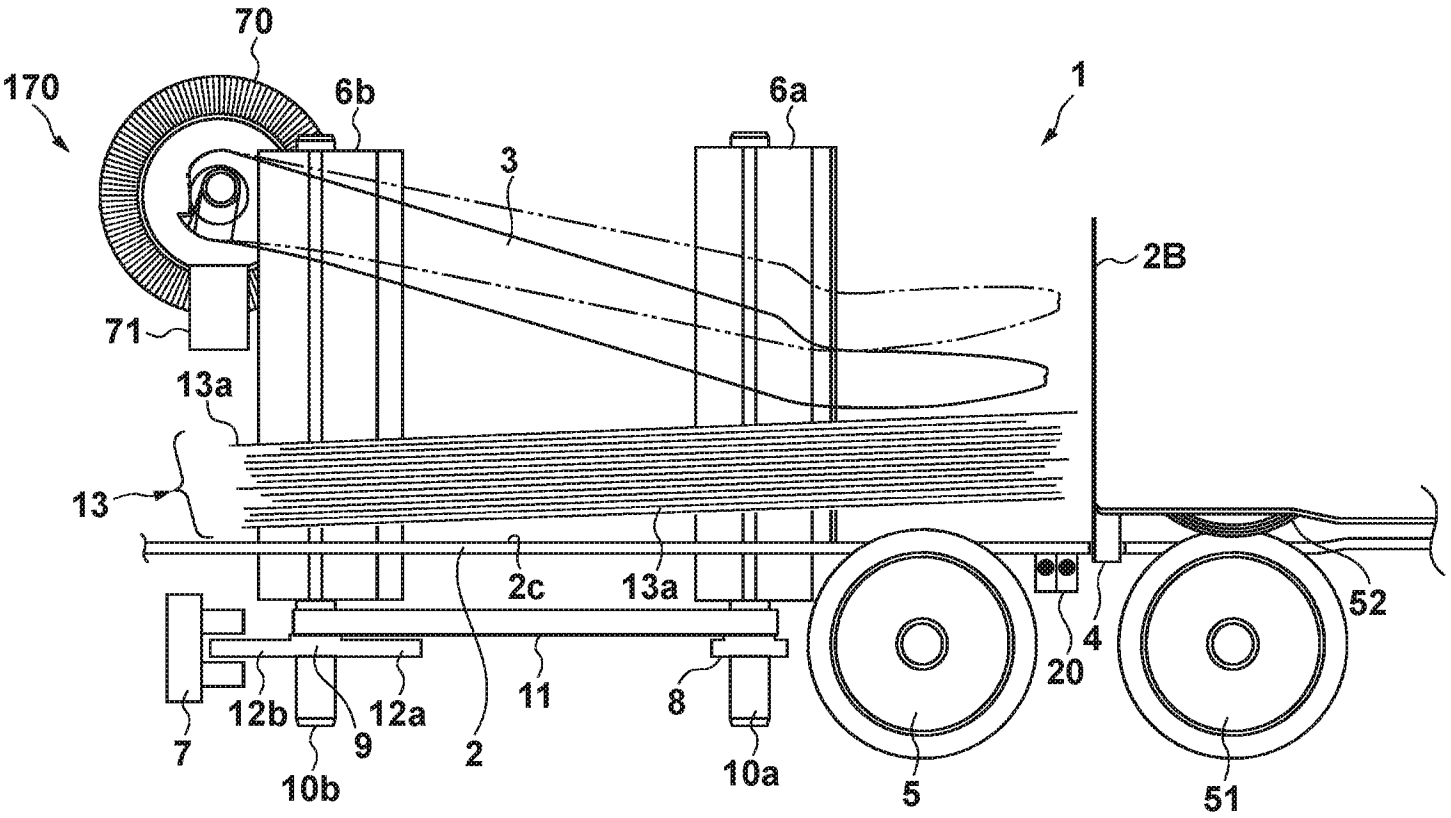
FIG. 1 is a view from above of a sheet material conveying apparatus.
Figure 2:
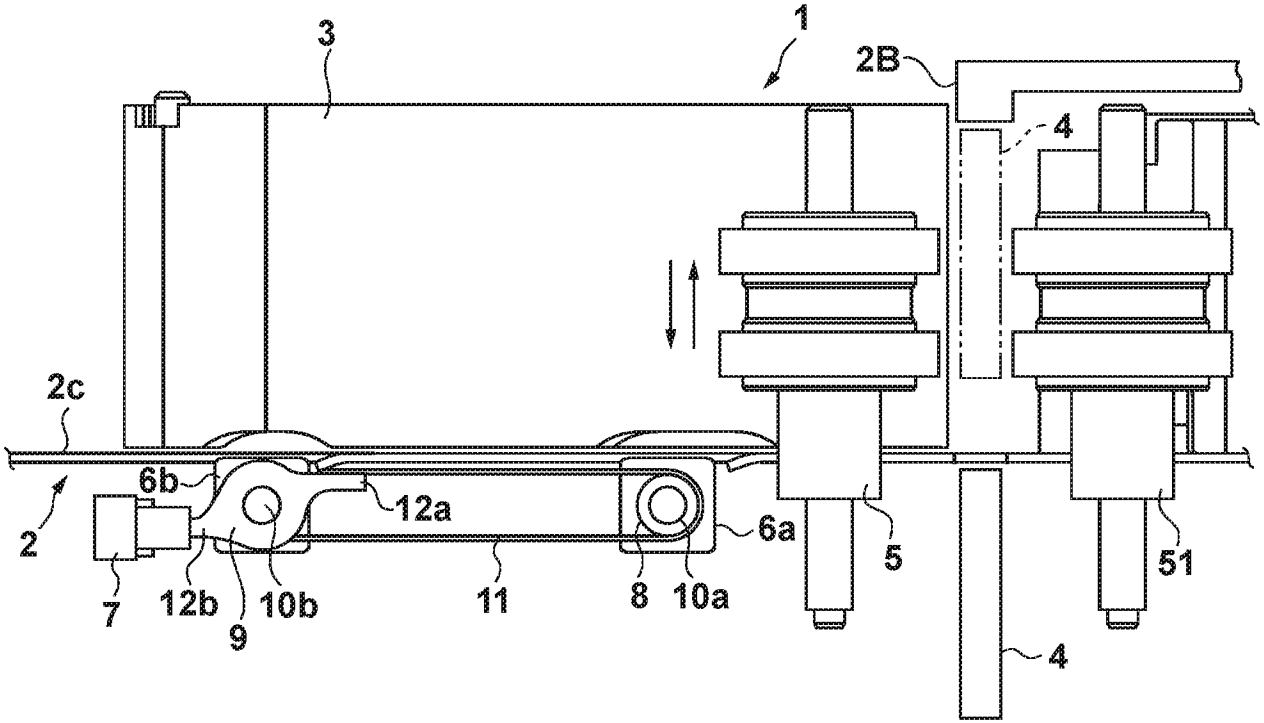
FIG. 2 is a cross-sectional side view of a sheet material conveying apparatus.

FIG. 1 is a view from above of the sheet material conveying apparatus according to the present embodiment, and FIG. 2 is side view from the right side of the sheet material conveying apparatus according to the present embodiment.

As shown in FIGS. 1 and 2, the sheet material conveying apparatus 1 includes a loading platform 2 on which a sheet bundle 13 composed of multiple sheet materials 13*a* is loaded in a state in which the overlapping direction of the sheet materials 13*a* is approximately the horizontal direction, or in other words, in a standing orientation. Note that in the present embodiment, the sheet bundle 13 stands almost vertically, but in an embodiment in which the overlapping direction of the sheet materials 13*a* is approximately the horizontal direction, a case is also included in which the sheet materials 13*a* stand at approximately 40 degrees, where 0 degrees is vertical.

The pressure plate 3 presses the sheet bundle 13 such that the end portions of the sheet bundle 13 are in contact with the loading surface 2C of the loading platform 2. The pressure plate 3 functions as pressing unit configured to press the sheet bundle 13 to a paper supply roller 5 on the loading platform. In order to detect an opening amount of the pressure plate 3, an encoder sensor unit 170 is attached to the end portion of the pressure plate 3. When the sheet bundle 13 is not on the loading platform 2, a biasing mechanism (not shown) keeps the pressure plate 3 in contact with the paper supply roller 5. This is the initial state. In this way, the biasing mechanism functions as a driving unit that causes the pressure plate 3 to pivot at one end portion thereof.

When sheet bundles 13 are stacked on the loading platform 2, the opening amount of the pressure plate 3 changes in proportion to the thickness amount of the sheet bundle 13. The encoder sensor unit 170 is installed below the rotation axis of the pressure plate 3, and a slit plate 70 rotates in synchronization with the rotation of the pressure plate 3. An encoder 71 outputs an encoder pulse due to the slits provided in the slit plate 70 blocking and allowing passage of the light path from a light emitting element in the encoder 71 to a light receiving element.

As shown in FIG. 2, pulleys 8 and 9 are adhered to the axes 10*a* and 10*b* of the rotating members 6*a* and 6*b*. The pulleys 8 and 9 are connected to each other via a belt 11. Also, the rotating member 6*a* is connected to an alignment motor by a gear. Accordingly, due to the alignment motor rotating, the rotating member 6*a* rotates, and the rotation force is furthermore transmitted to the rotating member 6*b* via the pulleys 8 and 9 and the belt 11, whereby the rotating member 6*b* rotates as well.

Protruding portions 12*a* and 12*b* are provided on the pulley 9 at about 180 degrees apart from each other in the circumferential direction. The protruding portions 12*a* and 12*b* rotate accompanying the rotation of the pulley 9. Each time the pulley 9 rotates halfway, it blocks the light to the protrusion sensor 7. When the light path to the protrusion sensor 7 is blocked by the protruding portions 12*a* and 12*b* at a certain rotation period of the pulley 9, the protrusion sensor 7 sends an electrical signal indicating that the light has been blocked to the control unit (not shown). The control unit detects the rotation position of the rotating members 6*a* and 6*b* based on the electrical signal from the protrusion sensor 7. When the sheet material conveying apparatus 1 is in a standby state, the rotating members 6*a* and 6*b* do not protrude from the loading surface 2C of the loading platform 2, as shown in FIG. 2, and have stopped at a retracted position below the loading surface 2C. At this time, the protruding portions 12*a* and 12*b*, which form blade portions of the rotating members 6*a* and 6*b*, block the light path to the protrusion sensor 7, according to which the control unit judges that the rotating members 6*a* and 6*b* are at the standby position.

An electrical signal indicating light blockage is output from the protrusion sensor 7 each time the rotating members 6*a* and 6*b* rotate 180 degrees. Accordingly, if a counter is reset each time the electrical signal is input, the count value of the counter indicates the specific rotation positions of the rotating members 6*a* and 6*b*. Note that it is also possible to obtain the rotation position from the count value without resetting the counter. Also, if a function or a table is prepared in advance for the count values and is applied in this case, it is possible to obtain the protrusion amount of the corner portions with respect to the loading surface 2C. The function or table is determined in advance by simulation or experimentation. Note that the rotation position or protrusion amount can be obtained by providing an encoder unit in either of the rotating members 6*a* and 6*b* as well. If the encoder pulses output by the encoder unit are counted by a counter, the count value indicates the rotation position.

After the operation for aligning the sheet bundle 13 is complete, a sheet material 13*a* loaded on the loading platform 2 is supplied by the paper supply roller 5, and the supplied sheet material 13*a* is conveyed to a conveyance path by a feed roller 51 and a retard roller 52. Thus, the rollers function as take-in unit configured to take in the sheet material 13*a* from the loading platform 2C to the interior of the apparatus body. An image sensor is provided on the conveyance path. The image sensor reads an image of the sheet material 13*a*. The image reading apparatus may be an image scanner that is used while connected to a personal computer, a mobile scanner driven by a battery or the like, a stand-alone scanner, or an image reader for a copying machine or multifunction printer.

In the case of being supplied in an overlapping manner, the sheet materials 13*a* are conveyed to the conveyance path by the feed roller 51 in a state of being separated one by one into individual sheet materials 13*a* by the retard roller 52. At this time, the pressure plate 3 is open in proportion to the sheet bundle amount.

An abutment portion 2B and a shutter 4 are provided between the paper supply roller 5 and the feed roller 51 and retard roller 52. During the operation for aligning the sheet bundle 13, the end portion in the conveying direction of the sheet bundle 13 abuts the abutment portion 2B and the shutter 4. According to this, the end portions in the conveying direction of the sheet bundle 13 are aligned, and oblique traveling of the sheet materials 13*a* is suppressed. A sheet material detection sensor 20 that detects the sheet materials 13*a* loaded on the loading platform 2 is provided near the shutter 4.

Control System

Figure 3:
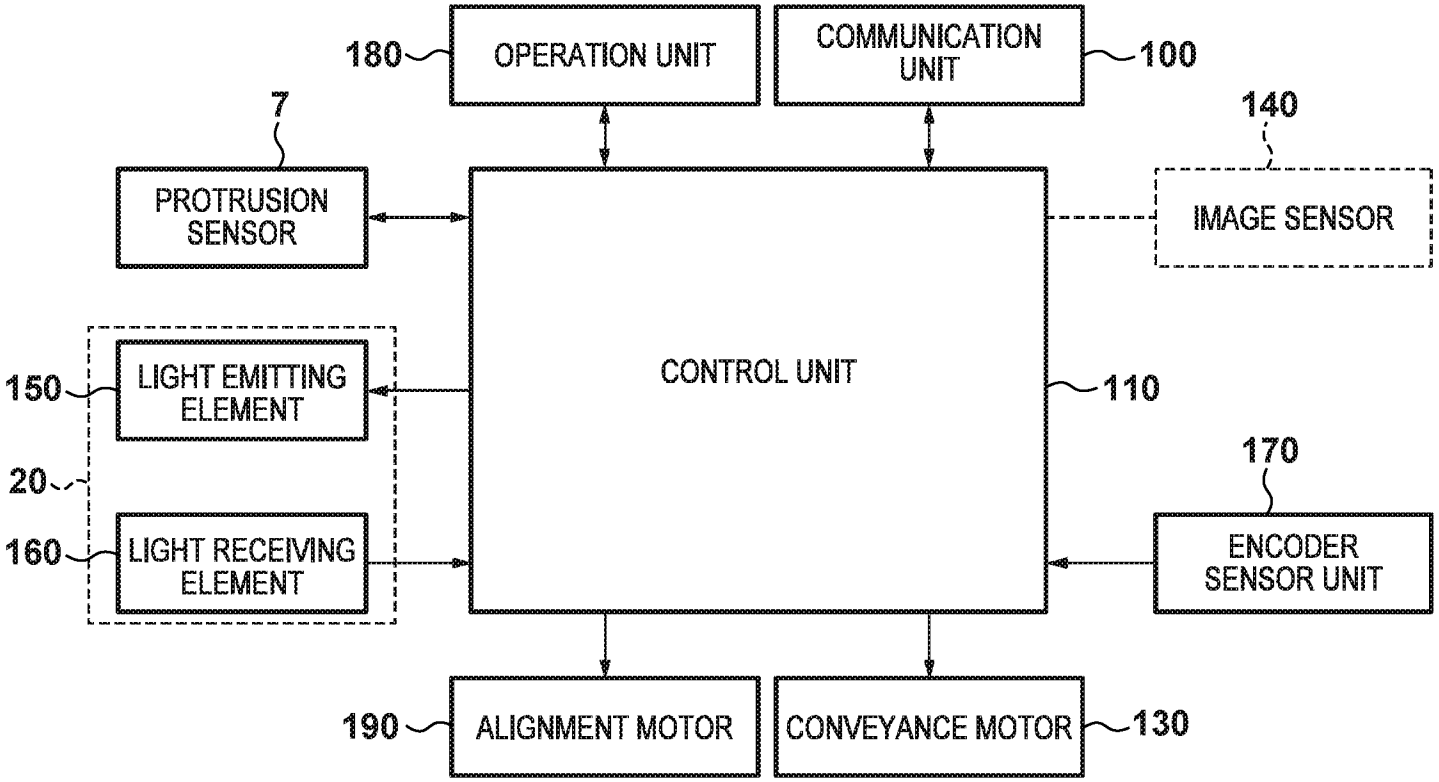
FIG. 3 is a block diagram showing a control system of a sheet conveying apparatus.

FIG. 3 is a block diagram showing a control system of the sheet material conveying apparatus 1. An operation unit 180 receives instructions for a conveying operation, an alignment operation, or the like from a user, and displays information from a control unit. The communication unit 100 receives instructions for a conveying operation or an alignment operation from an external apparatus (not shown) and transmits an image read by an image sensor 140 to the external apparatus. A conveyance motor 130 drives various types of movable members, such as the paper supply roller 5, the feed roller 51, and the retard roller 52. The conveyance motor 130, paper supply roller 5, and feed roller 51 function as conveying unit configured to convey the sheet materials 13*a* of the sheet bundle 13.

The alignment motor 190 that aligns the sheet bundle rotates the rotating members 6*a* and 6*b* for aligning the sheet bundle 13. The control unit 110 drives the motors and like based on detection signals received from various sensors, or in other words, based on the start signals from the control panel. For example, the control unit 110 receives an encoder pulse from the encoder sensor unit 170, and thereby acquires information on the opening amount of the pressure plate. Specifically, the control unit 110 can detect the amount of change in the pressure plate 3 from the initial state by counting the input encoder pulses. The control unit 110 calculates the amount of the sheet bundle 13 stacked on the loading platform 2 based on the amount of change of the pressure plate 3. If it is determined that the amount of the sheet bundle 13 is greater than a threshold value, the control unit 110 raises the torque of the alignment motor 190. This is because if the amount of the sheet bundle 13 increases, the load on the alignment motor 190 driving the rotating members 6*a* and 6*b* increases. In other words, the control unit 110 can achieve optimization of the alignment operation by setting an optimal torque. On the other hand, if it is determined that the amount of the sheet bundle 13 is less than or equal to a threshold value, the control unit 110 lowers the torque of the alignment motor 190. This is because if the amount of the sheet bundle 13 decreases, the load on the alignment motor 190 decreases. By changing the torque of the rotating members 6*a* and 6*b* according to the amount of the sheet bundle 13, it is possible to reduce needless energy consumption. Note that here, the torque of the alignment motor 190 is changed, but, for example, it is possible to appropriately control the alignment of the sheet bundle by changing various types of driving conditions, such as the driving time and rotation speed of the alignment motor 190. Thus, the control unit 110 functions as a control unit configured to control the operation of the aligning unit based on the pressing position of the sheet materials 13*a* pressed by the pressure plate 3. Note that the control unit 110 may control the operation of the aligning unit based on the pressing position of the sheet materials 13*a* pressed by the pressure plate 3 when the operation unit 180 is being operated on.

If it is determined that the amount of the sheet bundle 13 is greater than a threshold value, the control unit 110 may set the alignment time such that it is longer. This is because it takes time to align the leading ends and the bottom portion of the sheet bundle 13. On the other hand, if it is determined that the amount of the sheet bundle 13 is less than a threshold value, the alignment time may be set such that it is shorter. This is because if the amount of the sheet bundle 13 is small, it will not take much time to align the leading ends and bottom portion of the sheet bundle. Here, the alignment time refers to the amount of time for driving the rotating members 6*a* and 6*b*. Note that the control unit 110 may adjust the torque of the alignment motor 190 or the alignment time in proportion with the amount of the sheet bundle 13. Thus, by changing the alignment time according to the amount of the sheet bundle 13, the alignment time can be reduced to the shortest time needed. For this reason, the user is not constrained more than is necessary by the alignment time, and user-friendliness can be improved.

Incidentally, the unit configured to detect the opening amount of the pressure plate 3 is not limited to being the encoder sensor unit 170, and the opening amount (distance) may be detected by measuring the distance to the sheet bundle 13 using an ultrasonic element, or the opening amount of the pressure plate 3 may be acquired by detecting the retraction amount of a pressure spring for biasing the pressure plate 3. Note that when the later-described operation for aligning the sheet bundle 13 is started, the pressure plate 3 may be separated from the position of pressing the sheet material 13*a* so as to move to a retraction position due to the control unit 110 controlling the alignment motor 190.

The control unit 110 detects the rotation position of the rotating members 6*a* and 6*b* based on the detection signal from the protrusion sensor 7. The sheet material detection sensor 20 detects a sheet material 13*a* due to light emitted from a light emitting element 150 being reflected by a sheet material 13*a* and the reflected light being received by a light receiving element 160.

Alignment Processing

Figure 4:
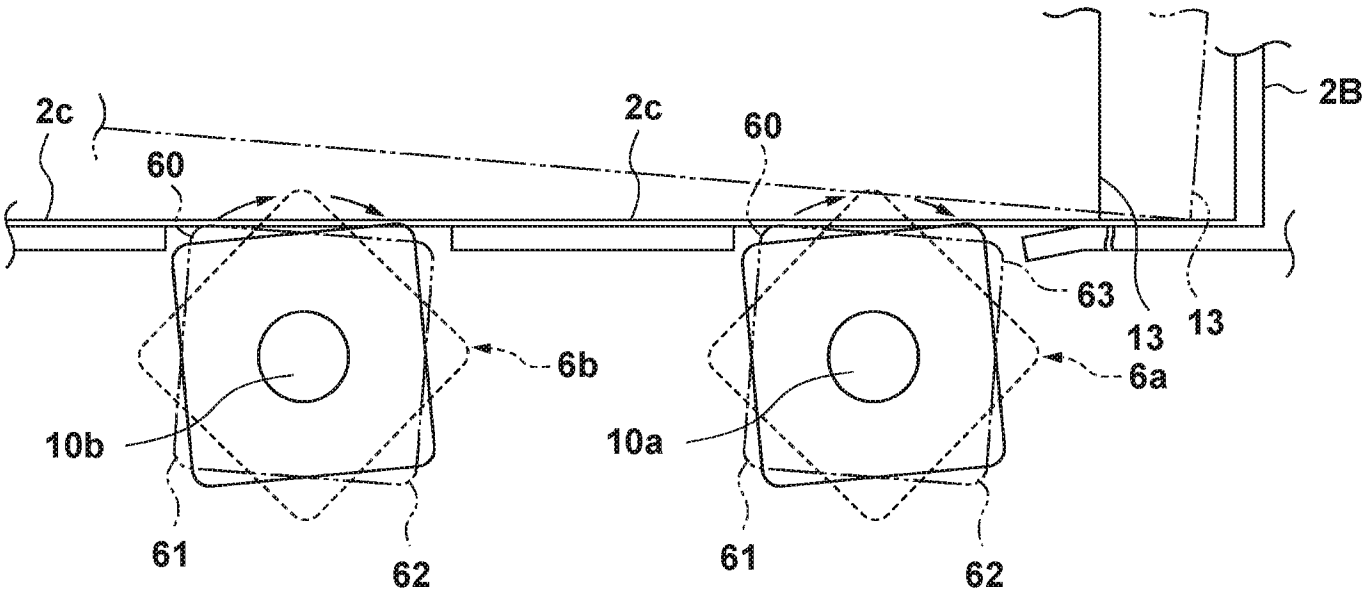
FIG. 4 is a diagram for illustrating an operation of a rotating member.

As shown in FIG. 4, two rotating members 6*a* and 6*b* serving as vibrating members constituting the aligning unit are arranged apart from each other in the sheet material conveying direction at a position below the loading platform 2. In FIG. 4, the rotating members 6*a* and 6*b* are formed into shapes that are square in cross-section. Due to the rotating members 6*a* and 6*b* rotating, a portion of the outer circumferences thereof (corner portions 60, 61, 62, and 63) protrude from the loading surface 2C. According to this, the sheet bundle 13 placed on the loading surface 2C vibrates up and down. The rotating members 6*a* and 6*b* rotate in a direction in which the corner portions 60, 61, 62, and 63 cause the sheet bundle 13 to abut the abutting portion 2B. That is to say, the sheet bundle 13 proceeds toward the abutting portion until the leading end portions of the sheet bundle 13 abut the abutting portion 2B and the shutter 4. This makes it possible to simultaneously align the leading end portions and the bottom portion of the sheet bundle 13 loaded on the loading platform 2. Thus, in the present embodiment, the vibration of the vibrating member is transmitted to the sheet bundle 13 so as to align the sheet bundle in the alignment space formed by the pressure plate 3, the loading surface 2*c* of the loading platform 2, the vibrating member (corner portions 60, 61, 62, and 63) that vibrates the sheet bundle 13, and the abutting portion 2B that is abutted by the leading end portions in the take-in direction of the sheet bundle 13 being fed by the paper supply roller 5.

Figure 5:
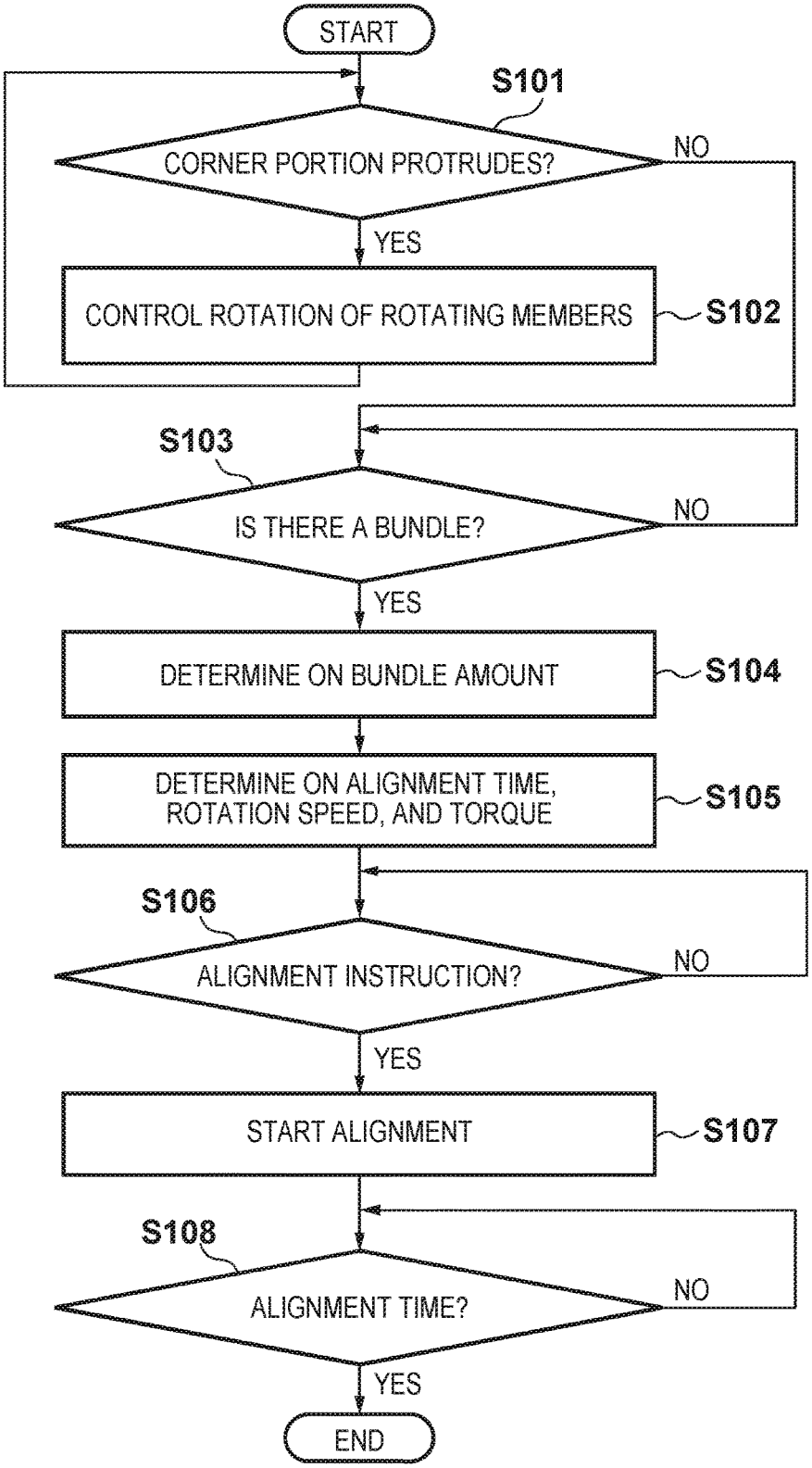
FIG. 5 is a flowchart showing a flow up to determining on an alignment operation condition.

Next, a method for determining on an alignment control setting, which is the alignment condition of the sheet bundle 13 in the sheet material conveying apparatus 1, will be described with reference to FIG. 5.

In step S101, the control unit 110 determines whether or not the corner portion 60, 61, 62, or 63 of the rotating member 6*a* is protruding from the loading surface 2C of the loading platform 2. For example, the control unit 110 determines whether or not the detection signal from the protrusion sensor 7 is a signal that means protrusion of a corner portion. As described above, the counter is reset when a signal indicating blockage of light is received from the protrusion sensor 7, and thus it can be determined based on the count value whether or not the corner portions 60, 61, 62, or 63 of the rotating members 6*a* and 6*b* are protruding from the loading surface 2C of the loading platform 2. This is because the protruding portions 12*a* and 12*b* are fixed to the rotating members 6*a* and 6*b*. Note that the protrusion states of the corner portions 60, 61, 62, and 63 of the rotating member 6*a* and the rotating member 6*b* are synchronized by the belt 11. The reason for determining whether or not the corner portions 60, 61, 62, and 63 are protruding from the loading surface 2C of the loading platform 2 is as follows. Sometimes the rotating members 6*a* and 6*b* are rotated by some cause and the corner portions 60, 61, 62, and 63 protrude from the loading surface 2C of the loading platform 2 when the power source of the sheet material conveying apparatus 1 is not turned on. If conveying of the sheet materials 13*a* is started in this state, the sheet bundle 13 will be oblique with respect to the loading surface 2C in some cases. In such a case, the sheet materials 13*a* will be damaged, accurate reading of the magnetic ink characters can no longer be performed, and the like. In view of this, control is performed such that the corner portions 60, 61, 62, and 63 do not protrude from the loading surface 2C of the loading platform 2. If the corner portions 60, 61, 62, and 63 do not protrude from the loading surface 2C of the loading platform 2, the processing moves to step S103. If the corner portions 60, 61, 62, and 63 protrude from the loading surface 2C of the loading platform 2, the processing moves to step S102.

In step S102, the control unit 110 rotates the alignment motor 190 and returns to step S102. Accordingly, if the corner portions 60, 61, 62, and 63 are not protruding from the loading surface 2C of the loading platform 2, the control unit 110 stops the alignment motor 190 and moves to step S103.

In step S103, the control unit 110 determines whether or not the sheet material detection sensor 20 has detected a sheet material 13*a* (sheet bundle 13). When the user sets the sheet bundle 13 (sheet materials 13*a*) on the loading platform 2, the sheet material detection sensor 20 detects the sheet bundle 13 and the sheet bundle detection signal is input to the control unit 110. When the sheet bundle 13 is detected, the processing moves to step S104. Note that in parallel with this, the control unit 110 counts the encoder pulses from the encoder sensor unit 170 and acquires the rotation amount or opening amount of the pressure plate 3, or in other words, acquires information regarding the pressing position of the pressure plate 3.

In step S104, the control unit 110 obtains the bundle amount of the sheet bundle 13 from the rotation amount of the pressure plate 3. It is assumed that the control unit 110 includes a function or a table for converting the rotation amount of the pressure plate 3 into the bundle amount of the sheet bundle 13 in advance. It is thought that the rotation amount of the pressure plate 3 is proportionate to the bundle amount of the sheet bundle 13. In this way, the encoder sensor unit 170 and the control unit 110 function as detecting unit configured to detect an amount of a sheet bundle loaded on the loading platform.

In step S105, based on the bundle amount, the control unit 110 determines on the alignment control setting (alignment condition) such as the alignment time and the rotation torque and rotation speed of the alignment motor 190. It is assumed that the control unit 110 includes a function or a table for converting the bundle amount into the alignment time, rotation torque, and rotation speed. Note that the function or table is prepared for each size of sheet material 13 (e.g., A4, B5) and the control unit 110 may switch between functions and tables according to a size input from an operation unit. Note that it is possible to set only one of the torque, rotation speed, and alignment time, which is the time for continuously executing alignment processing, of the drive source (alignment motor 190), or the alignment control setting may be set using a combination of two or more of these. In this way, the control unit 110 functions as determining unit configured to determine on an alignment condition according to the amount of the sheet bundle detected by the detecting unit.

In step S106, the control unit 110 determines whether or not the alignment start condition has been satisfied. For example, the alignment start condition is that a start instruction for the alignment operation has been input from the operation unit 180 or the communication unit 100. Note that step S106 may be omitted. In other words, the alignment operation may be started immediately using a setting that was determined on, without determining whether or not an alignment instruction has arrived.

In step S107, the control unit 110 starts the timer for measuring the alignment time and starts driving the alignment motor 190. By driving the alignment motor 190 with a rotation torque and rotation speed that are appropriate for the bundle amount, the control unit 110 rotates the rotating members 6*a* and 6*b* in order to vibrate the sheet bundle 13. In this way, the alignment motor 190 and the rotating members 6*a* and 6*b* function as aligning unit configured to align the sheet bundle 13 (sheet materials 13*a*) placed on the loading platform in accordance with the alignment condition that was determined on.

In step S108, the control unit 110 determines whether or not the alignment time has elapsed by comparing the count value of the timer with the alignment time. When the alignment time elapses, the operation of the alignment motor 190 is stopped. In this way, when the alignment processing ends, the sheet bundle 13 is in a state of being aligned.

In the present embodiment, a configuration is used in which the sheet bundle 13 is vibrated in the up-down direction and the conveyance direction using rotating members 6*a* and 6*b*. However, a configuration may be used in which the loading surface 2C is arranged obliquely and the sheet bundle 13 is vibrated in only the up-down direction.

Figure 6:
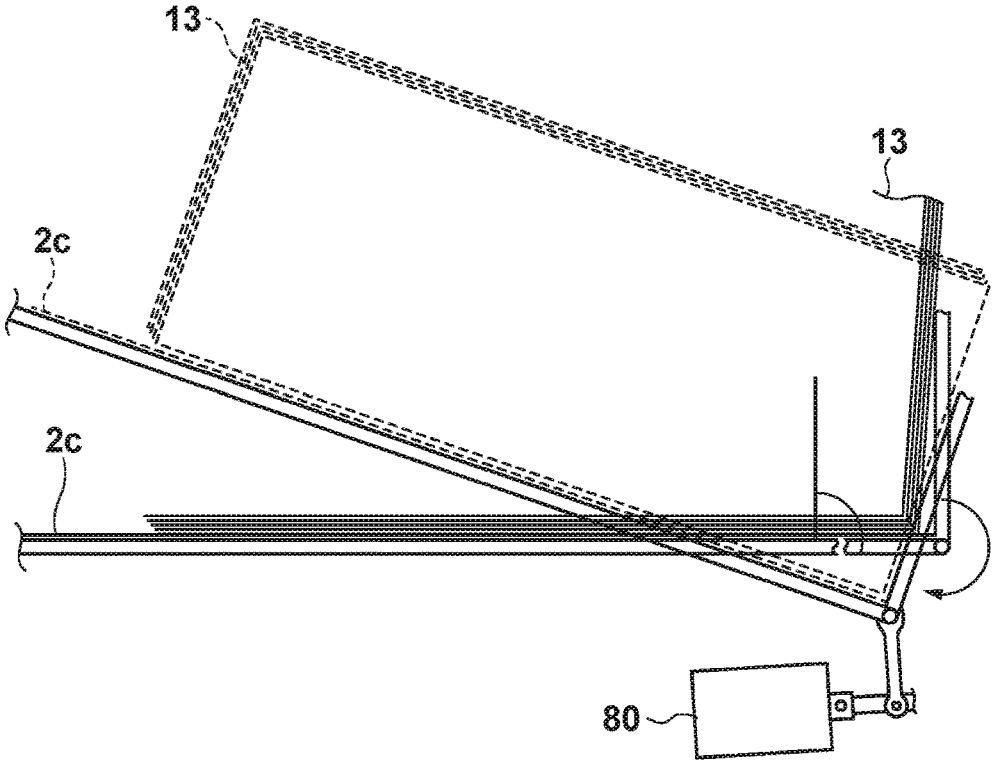
FIG. 6 is a configurational diagram showing an example of an alignment operation.

For example, as shown in FIG. 6, a solenoid 80 may be used as the driving source that causes the loading surface 2C of the loading platform 2 to vibrate. In other words, the loading surface 2C of the loading platform 2 is vibrated using the power drawn by the solenoid 80. The motion in the lateral direction of the solenoid 80 may be converted into vibration in the up-down direction using a mechanical mechanism.

Figure 7:
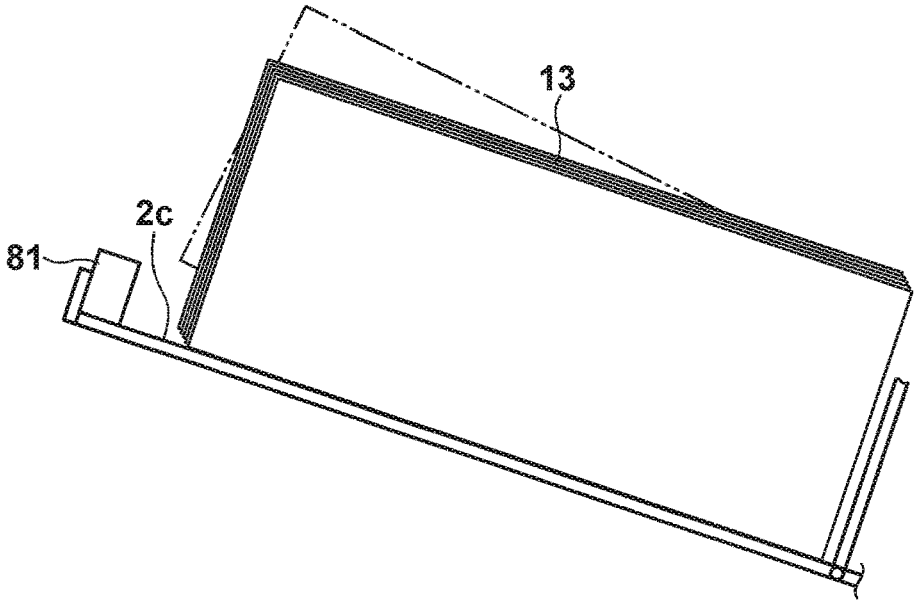
FIG. 7 is a configurational diagram showing an example of an alignment operation.

Also, as shown in FIG. 7, a piezoelectric element 81 that vibrates at a high speed may be used. Due to one point of the loading surface 2C of the loading platform 2 being vibrated, the entire loading surface 2C vibrates, and the sheet bundle 13 stacked on the loading surface 2C also vibrates. According to this, the sheet bundle 13 may be aligned.

As described above, in the present embodiment, by merely loading the sheet bundle 13 on the loading platform 2 and switching on an alignment start switch of the operation unit 180, the alignment control setting for the sheet bundle 13 is determined on automatically. That is to say, since alignment control settings are determined on according to the amount of the sheet bundle 13, the sheet bundle 13 can be aligned more efficiently compared to the case where the user manually determines on the settings, or compared to the case where alignment is performed using the same condition for all sheet bundles. This makes it possible to solve problems such as the amount of time by which the user is constrained being extended due to the alignment time being too long, as well as problems such as conveyance being started while the alignment of the sheet bundle 13 is still incomplete due to the alignment time being too short.

Furthermore, a vibrating member that vibrates the sheet bundle 13 in the up-down direction while moving it in the conveyance direction and an abutting portion 2B that is abutted by the leading end portions of the sheet bundle 13 moving in the conveyance direction are included. This makes it easier to align the bottom portion of the sheet bundle 13 since the sheet materials 13*a* fall separately in the direction of gravity due to repeatedly vibrating in the up-down direction. Also, after moving in the conveyance direction, the leading end portions of the sheet bundle 13 repeatedly abut the abutting portion 2B, and therefore the leading end portions of the sheet bundle 13 are aligned. Accordingly, it is possible to simultaneously align both the bottom portion and the end portions in the conveyance direction of the sheet bundle 13.

Also, the bundle amount of the sheet bundle 13 stacked on the loading platform 2 can be calculated based on the movement amount (rotation amount or opening amount) of the pressure plate 3, and the vibration intensity (rotation torque and rotation speed) can be adjusted according to the bundle amount. Since the alignment operation for the sheet bundle 13 can be performed under alignment conditions suitable for the bundle amount, it is possible to efficiently align the sheet bundle.

Furthermore, by using the rotating members 6*a* and 6*b* for the vibration operation of the sheet bundle 13 loaded on the loading platform 2, it is possible to vibrate the sheet bundle 13 efficiently and at a high speed. In other words, since it is possible to finely vibrate the sheet bundle 13, it is possible to efficiently perform alignment from the bottom portion of the sheet bundle.

Embodiment 2

In the present embodiment, alignment processing in the case where another sheet bundle is added during take-in (feeding) or conveying of the sheet materials 13*a* will be described. Note that the description is simplified by using the same reference numerals in locations that have already been described. For example, addition of a sheet bundle or sheet in this context includes a case in which a user inserts a sheet bundle or sheet in the loading platform 2 before the sheet feeding operation is started, after the sheet feeding operation is started, or the like, or a case in which a sheet bundle supplying apparatus is provided separately and a sheet bundle or a sheet is inserted automatically into the loading platform 2.

Figure 8:
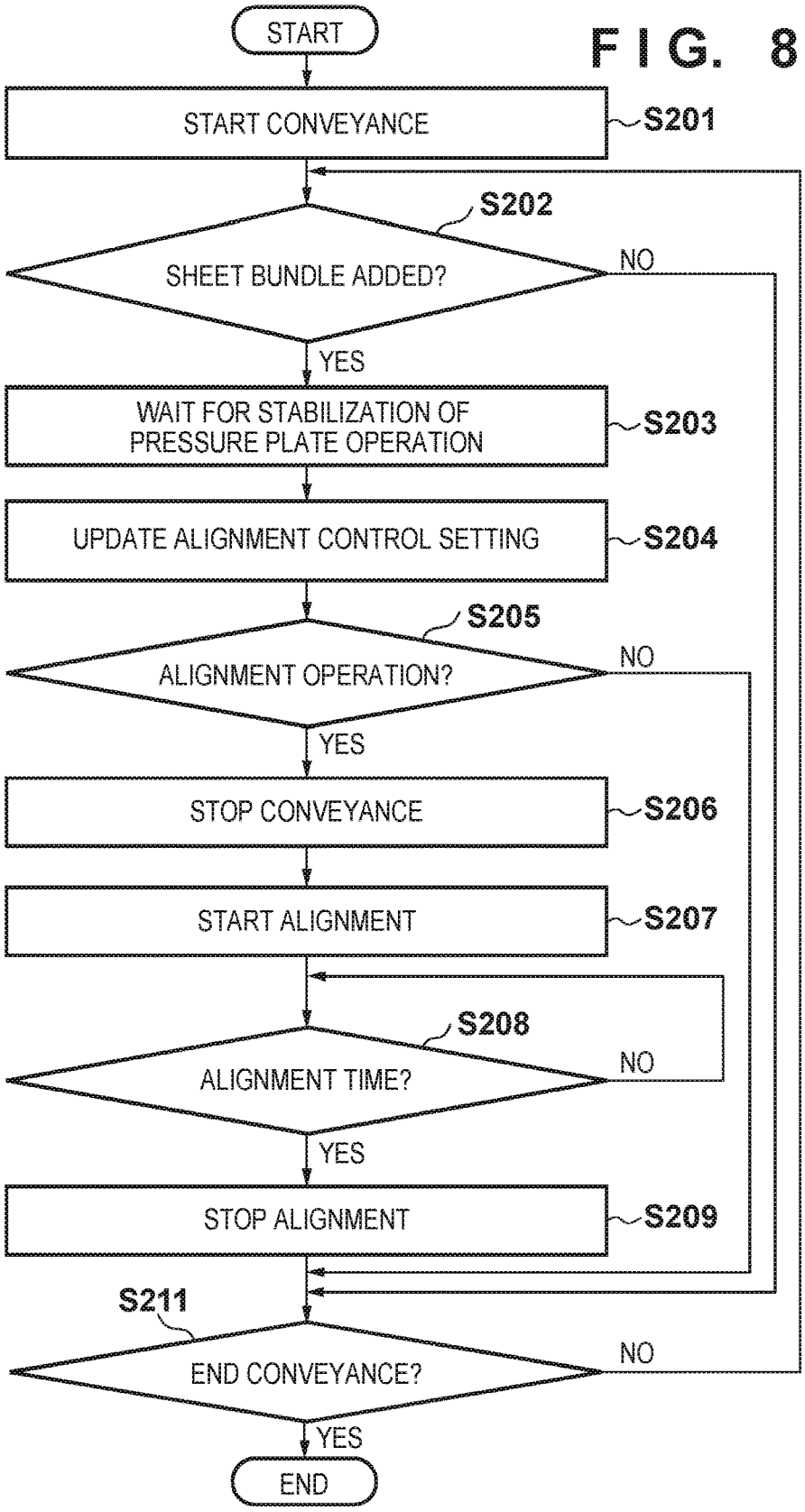
FIG. 8 is a diagram showing a control sequence for adding during conveying.

A sequence in the case of adding a sheet bundle during conveying of a sheet material 13*a* will be described next with reference to FIG. 8. In step S201, the control unit 110 starts driving the conveyance motor 130 in order to start conveying the sheet materials 13*a*. Note that the control unit 110 acquires the encoder pulse from the encoder sensor unit 170 while the sheet material 13*a* is being conveyed and thereby monitors the opening amount of the pressure plate 3 (bundle amount of the sheet bundle 13).

In step S202, the control unit 110 determines whether or not a sheet bundle has been added. For example, the control unit 110 determines whether or not the opening amount of the pressure plate 3 has increased such that the opening amount exceeds a predetermined threshold value in the increasing direction. When a sheet bundle 13 is added to the loading platform 2 during a sheet conveying operation, the opening amount of the pressure plate 3 changes in proportion to the thickness amount of the sheet bundle 13. In view of this, the control unit 110 may store the opening amount at the time when conveyance of the sheet material 13*a* starts (initial opening amount) in the memory and determine whether or not a difference between the initial opening amount and the current opening amount exceeds a predetermined threshold value. Note that a parameter (sheet bundle amount) obtained using the opening amount of the pressure plate 3 may be used instead of the opening amount of the pressure plate 3. If a sheet bundle has been added, the processing moves to step S203, and if no sheet bundle has been added, the processing moves to step S211. In this way, the control unit 110 functions as a determining unit configured to determine whether or not another sheet bundle has been added to the loading platform based on the amount of the sheet bundle detected by the detecting unit.

Note that when a sheet bundle has been added, the control unit 110 may immediately stop the conveyance motor 130. Sometimes an aligned sheet bundle becomes misaligned due to addition of a sheet bundle. In view of this, the conveyance motor 130 may be stopped until alignment processing for all of the sheet bundles, including the added sheet bundle, is complete. However, taking into consideration the fact that conveying is performed starting from the sheet material 13*a* located on the bottom in the vertical direction of the sheet bundle remaining on the loading platform 2, and the fact that a sheet bundle is added above the sheet material 13*a* located on the top in the vertical direction of the sheet bundle remaining on the loading platform 2, the sheet material 13*a* located on the bottom rarely becomes misaligned. In view of this, in the present embodiment, conveying is still continued at this time. Note that if a sheet or a sheet bundle is added during sheet take-in, to temporarily or completely stop the sheet take-in operation may be done. After stopping, to allow the user to select whether to continue the sheet material take-in operation or to perform a sheet bundle alignment operation by displaying a selection screen on the display of the apparatus body or an external apparatus may be done. Also, a configuration may be used in which take-in of the sheet bundle is temporarily stopped before the addition so that an operation of aligning the added sheet bundle is executed. According to this, it is possible to accurately execute a take-in operation for sheets that are in the correct orientation due to alignment processing. In this way, the control unit 110 may change the sheet material take-in operation performed by the take-in unit when the pressing position of the sheet materials 13*a* pressed by the pressure plate 3 changes during take-in of the sheet materials 13*a* by the take-in unit.

In step S203, the control unit 110 stands by for a certain amount of time after addition of the sheet bundle is started. It is thought that the opening amount of the pressure plate 3 is not stable immediately after the pressure plate 3 is opened. This is because the sheet bundle 13 has not been completely loaded on the loading platform 2. In view of this, it may stand by for a certain amount of time until the opening amount of the pressure plate 3 becomes stable.

In step S204, the control unit 110 obtains the sheet bundle amount based on the opening amount of the pressure plate 3 and the alignment control setting of the alignment motor 190 is updated based on the sheet bundle amount. The method for obtaining the alignment control setting is the same as in step S105. Thus, the control unit 110 functions as an updating unit configured to update the alignment condition according to the total amount of the other sheet bundle and the sheet bundle remaining on the loading platform when the determining unit determine that another sheet bundle has been added to the loading platform. Note that it is also possible to align only the added sheet bundle. In this case, the alignment control setting is such that only the amount of the added sheet bundle is calculated and an alignment control condition appropriate for the calculated sheet bundle amount is set, but the present invention is not limited to this.

Here, the sheet alignment condition corresponding to the position change amount of the pressure plate 3 is stored in advance in the memory. For example, if a sheet bundle is added during a feeding or conveying operation, the position of the pressure plate 3 (pressing position) changes in the opening direction. If the change amount of the pressure plate 3 exceeds a predetermined change amount (threshold amount), the control unit 110 judges that the pressure plate 3 was opened intentionally for addition (determines that an addition was made). Then, the control unit 110 stores the opening position (initial opening position) of the pressure plate 3 for before the change amount of the pressure plate 3 exceeds the predetermined change amount (e.g., the threshold amount) in the memory in advance. When it is judged that an addition has been made, the control unit 110 stores the opening position of the pressure plate 3 after the sheet bundle has been added (opening position after addition), or in other words, the new pressing position of the pressure plate 3, in the memory. According to this, the control unit 110 subtracts a numerical value indicating the initial opening position from a numerical value indicating the opening position after addition, and thereby finds out the amount of change in the pressure plate 3 when an addition has been made (i.e., the amount of movement of the pressing position). Also, the control unit 110 loads the sheet alignment condition corresponding to the position change amount of the pressure plate 3 from the memory and thus selects the sheet alignment condition. According to this, the control unit 110 may execute an appropriate sheet bundle alignment operation. Here, by storing a sheet alignment condition table corresponding to the opening position of the pressure plate 3 in the memory in advance, the control unit 110 may quickly conduct an appropriate sheet bundle alignment operation corresponding to the position change amount of the pressure plate 3. Note that the opening position of the pressure plate 3 may be set finely. In such a case, the more alignment condition tables there are, the more the sheet alignment condition can be optimized. For example, if it is judged that a sheet bundle has been added during a feeding or conveying operation, the control unit 110 reads out the sheet bundle alignment condition from the alignment condition table corresponding to the position of the pressure plate 3 resulting from the addition of the sheet bundle. The control unit 110 reads out the alignment condition of the sheet bundle from the alignment condition table corresponding to the position before the next sheet bundle is added. The control unit 110 may determine on the appropriate sheet bundle alignment condition by calculating a sheet bundle alignment condition corresponding to the added sheet bundle based on the read-out sheet bundle alignment conditions for before and after the sheet bundle addition.

Returning to FIG. 8, in step S205, the control unit 110 determines whether or not the alignment start condition has been satisfied. For example, the alignment start condition is that a start instruction for the alignment operation has been input from the operation unit 180 or the communication unit 100. It is possible to select whether or not to perform an alignment operation according to a user instruction. If the alignment start condition has not been satisfied, the processing moves to step S211. If the alignment start condition has been satisfied, the processing moves to step S206.

In step S206, the control unit 110 stops the conveyance motor 130 and closes the shutter 4.

In step S207, the control unit 110 starts driving the alignment motor 190 in accordance with the alignment control setting. For example, a timer for measuring the alignment time is started.

In step S208, the control unit 110 determines whether or not the amount of time that has elapsed since the alignment operation started (count value of the timer) has exceeded a pre-set alignment time. If the count value exceeds the alignment time, the processing moves to step S211.

In step S211, the control unit 110 determines whether or not a conveyance end condition has been satisfied. For example, the conveyance end condition is that a stop command is input using the operation unit 180, or that the sheet material detection sensor 20 is no longer able to detect a sheet material. If a conveyance end condition is satisfied, the control unit 110 ends the conveyance processing. If the conveyance end condition is not satisfied, the processing returns to step S202 and the control unit 110 resumes conveyance processing.

Since the alignment control setting is automatically updated when a sheet bundle is thus added, it is possible to stably continue the conveyance operation. If the alignment operation is not performed when the sheet bundle is added, sometimes an added sheet material travels obliquely. With the present embodiment, oblique traveling and the like of the sheet materials 13*a* is suppressed since the alignment operation is executed by updating the setting according to the bundle amount of the sheet bundle 13.

Embodiment 3

In Embodiment 3, control has been added in which only the added sheet bundle can be aligned when addition of a sheet bundle occurs during conveyance. Embodiment 3 will be described next with reference to FIG. 9. Note that the description is simplified by using the same reference numerals in locations that have already been described.

Figure 9:
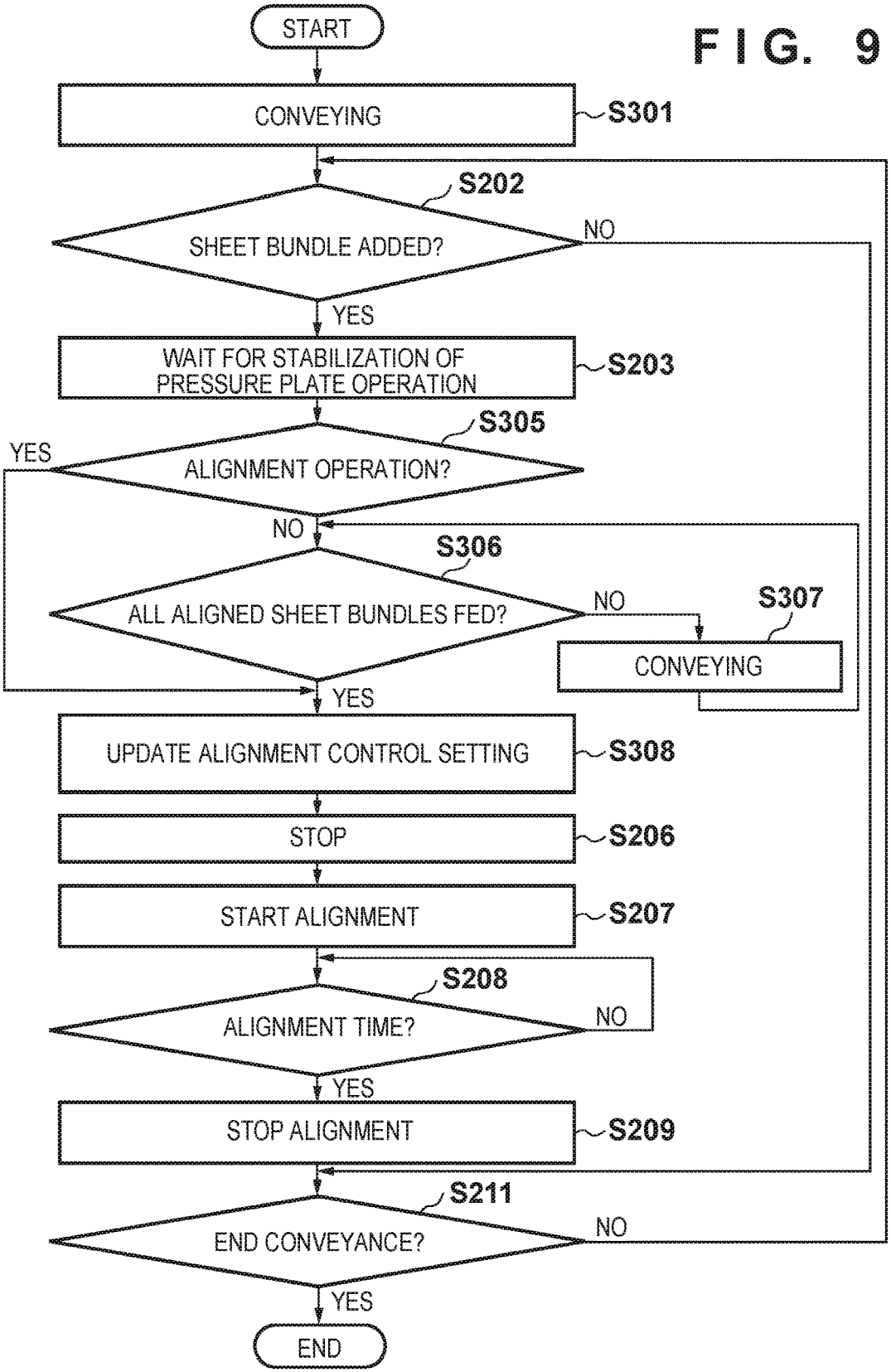
FIG. 9 is a diagram showing a control sequence for adding during conveying.

A sequence in the case of additional paper supply during conveyance will be described next with reference to FIG. 9. In step S301, a sheet is being conveyed. Thereafter, if additional paper supply is detected during conveyance in step S202 described above, the processing moves to step S203, and furthermore moves to step S305.

In step S305, the control unit 110 determines whether or not an immediate alignment start condition has been satisfied. For example, the immediate alignment start condition is that a start instruction for the alignment operation has been input from the operation unit 180 or the communication unit 100. According to this, it is possible to select whether to immediately align the added sheet bundle according to the user instruction or to align the added sheet bundle after conveyance processing of the aligned sheet bundle has ended. Note that the control unit 110 may output a message inquiring whether or not to immediately execute alignment of the other sheet bundle to the display apparatus of the operation unit 180 and receive a response to the message. The control unit 110 may judge whether or not to execute alignment of the other sheet bundle after the conveyance of the sheet bundle remaining on the loading platform 2 has ended, in accordance with the response received by the input apparatus of the operation unit 180. Thus, the control unit 110 functions as a judging unit configured to judge whether or not to execute alignment on the other sheet bundle after conveyance of the sheet bundle remaining on the loading platform has ended. If the immediate alignment start condition has been satisfied, the processing moves to step S308. In step S308, the control unit 110 updates the alignment condition according to the total amount of the other sheet bundle that was added and the sheet bundle remaining on the loading platform. Accordingly, when the control unit 110 judges that the other sheet bundle and the sheet bundle remaining on the loading platform are to be aligned together before the conveyance of the sheet bundle remaining on the loading platform 2 ends, the alignment condition is updated according to the total amount of the other sheet bundle that was added and the sheet bundle remaining on the loading platform, and the units are controlled such that the other sheet bundle is aligned in accordance with the updated alignment condition. Thereafter, in step S206, the control unit 110 temporarily stops the paper supply operation, and in step S207, the aligned sheet bundle and the added sheet bundle are aligned together.

On the other hand, in step S305, if the immediate alignment start condition has not been satisfied, the processing moves to step S306. In step S306, the control unit 110 determines whether or not the conveyance of the entire aligned sheet bundle has ended. For example, the control unit 110 obtains a bundle amount V3 of the added sheet bundle based on the difference between the bundle amount V1 immediately before the sheet bundle is added, and the bundle amount V2 after the addition (total amount of the aligned sheet bundle, which was there originally, and the added sheet bundle). Furthermore, the control unit 110 monitors the current bundle amount, and when the current bundle amount matches the bundle amount V3 of the added sheet bundle, it is determined that all of the aligned sheet bundles have been conveyed. If conveyance has not ended, the processing moves to step S307, conveyance is continued, and the processing moves to step S306. When the conveyance of all of the aligned sheet bundles ends, the processing moves to step S308.

In step S308, the control unit 110 updates the alignment control setting. The control unit 110 obtains the bundle amount of the added sheet bundle and determines on the alignment control setting according to the obtained bundle amount. That is to say, when it is judged that alignment of the other sheet bundle is to be executed after the conveyance of the sheet bundle remaining on the loading platform 2 has ended, the control unit 110 updates the alignment condition according to the amount of the other sheet bundle that was added. Thereafter, the processing moves to step S206. The processing from step S206 onward is as described above.

According to Embodiment 3, when a sheet bundle is added during conveyance, the user can select whether to immediately execute alignment including the aligned sheet bundle or to align only the added sheet bundle after conveyance of the aligned sheet bundle ends. For example, if there are 100 sheets in the aligned sheet bundle and 10 sheets in the added sheet bundle, the power consumption needed for the alignment processing can be reduced more by aligning only the 10 sheets than by performing alignment processing on the 110-sheet sheet bundle. Also, it is advantageous to align only the added sheet bundle after the conveyance of the aligned sheet bundle has ended also when the user wishes to give priority to conveying the aligned sheet bundle. For example, in an environment in which multiple users are present, there are cases where the user for the aligned sheet bundle and user for the added sheet bundle are different. In this case, a user who was using the sheet material conveying apparatus before might not wish to be interrupted by a user who uses the sheet material conveying apparatus thereafter. Accordingly, Embodiment 3 is useful in this kind of environment as well.

The above-described Embodiments 1 to 3 have been described taking the example of a sheet material conveying apparatus (sheet material take-in apparatus) having a loading platform in a state in which the overlapping direction of the sheet materials is approximately the horizontal direction, or in other words, a vertical-placement loading platform. However, the present invention is not limited thereto. That is to say, the mode of loading the sheet bundle is not limited to vertical placement, and it is possible to use a horizontal-placement (a method of placement in which the surface direction of the sheet material is approximately the horizontal direction) loading platform, or a configuration in which a sheet is placed on an inclined loading platform or slope member. In these cases, for example, the sheet bundle aligning unit may be configured to vibrate the entire loading platform along the sheet loading surface, or the sheet bundle aligning unit may be configured to vibrate a regulating plate installed in a standing manner on the sheet loading platform along the sheet loading surface so as to align the end portions of the sheet bundle. Also, regarding take-in of sheets, a take-in roller may be arranged on the sheet loading surface such that take-in is performed one sheet at a time starting from the sheet loading surface side, and it is also possible to use a take-in roller that is in contact with the uppermost surface of the sheet bundle (e.g., a pickup roller or the like). In the former case, it is possible to arrange the pressure plate on the uppermost surface side of the sheet bundle, and in the latter case, the sheet loading surface may take on the role of the pressure plate. In any case, the structure for taking in the sheet materials is not limited to the above-described Embodiments 1 to 3. The present invention can also be configured such that the added amount is detected using the above-described structure and the sheet bundle alignment operation is controlled based on the added amount.

The present invention is not limited to the above-described check scanner and can be applied to various sheet feeding apparatuses. Hereinafter, a description will be given taking the example of a sheet through-feeding apparatus that feeds a sheet along a sheet surface.

Figure 10:
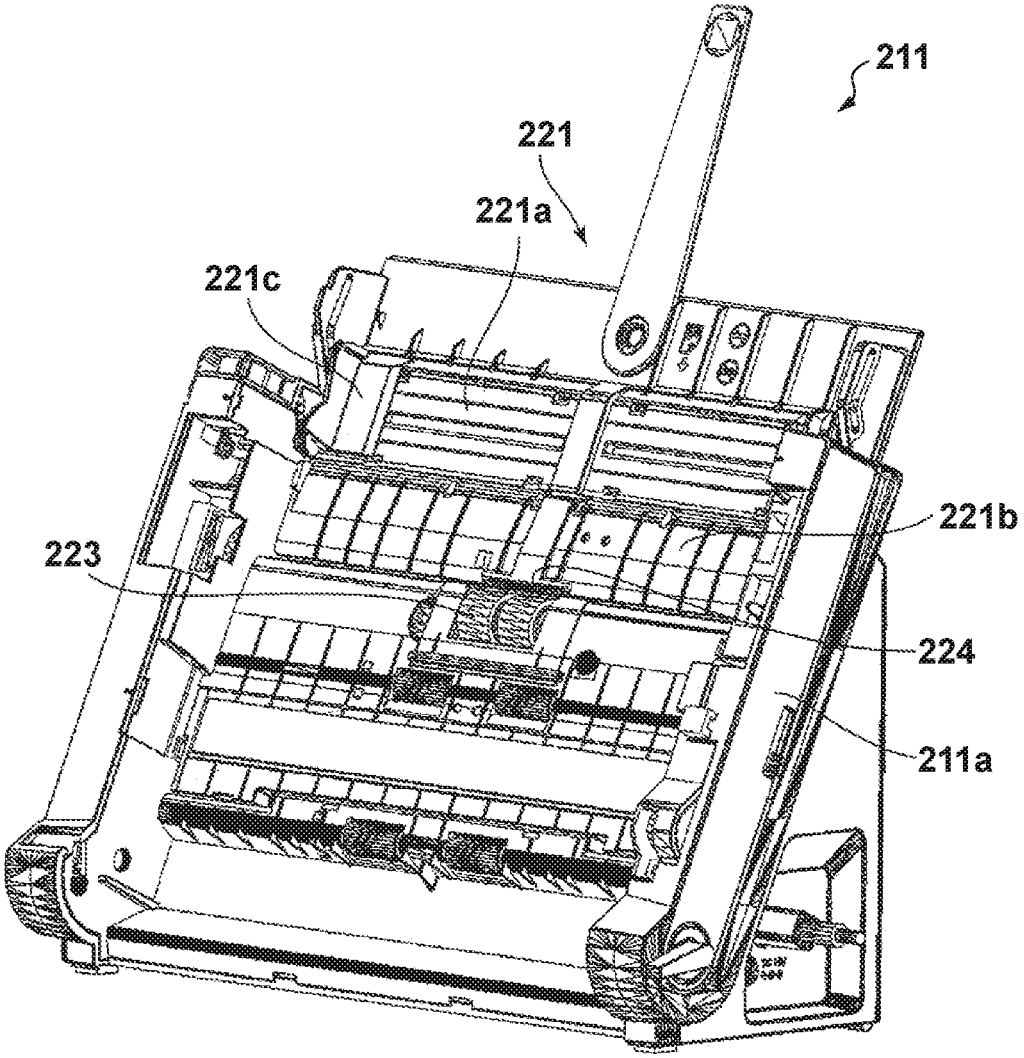
FIG. 10 is a diagram showing a sheet material conveying apparatus.
Figure 11:
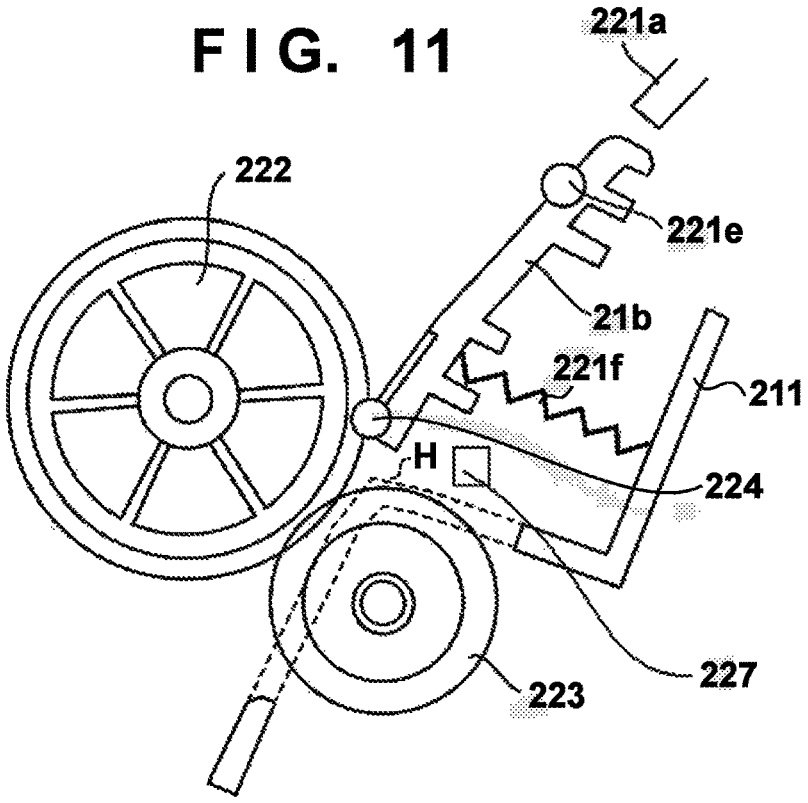
FIG. 11 is a cross-sectional view of a sheet material conveying apparatus.
Figure 12:
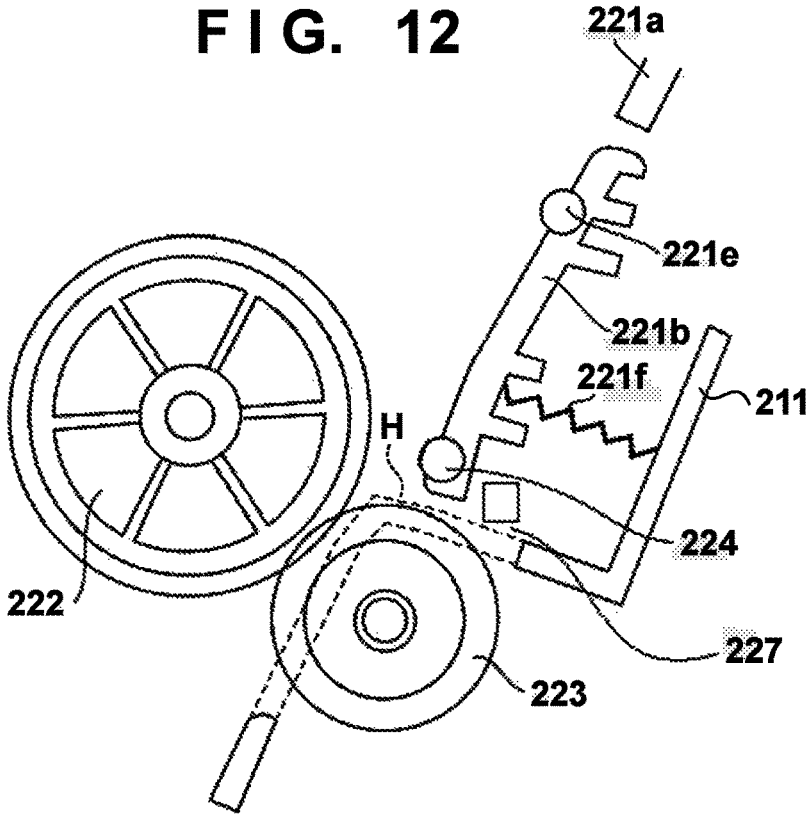
FIG. 12 is a cross-sectional view of a sheet material conveying apparatus.

FIG. 10 shows a sheet feeding apparatus (sheet conveying apparatus) of a type that feeds (conveys) sheets from the upper portion of an apparatus body 211 to the lower portion thereof. A tray 221 on which a sheet bundle is loaded is provided at an angle with respect to the horizontal direction, as shown in FIG. 11. Specifically, the tray 221 has a fixed plate 221*a* that is fixed to a main body portion 211*a* of the apparatus body 211, and an intermediate plate 221*b*, which is a sheet receiving member supported pivotably with respect to the apparatus body 211. The fixed plate 221*a* is provided so as to protrude obliquely upward from a paper supply port (FIG. 10) provided on the upper portion of the apparatus body 211. Also, as shown in FIG. 10, a slide member 221*c* is provided movably in the width direction (front-rear direction in FIGS. 11 to 14) on the surface of the fixed plate 221*a* on which the sheet is loaded. The slide member 221*c* functions as a regulating member that regulates the positions of the sheets by coming into contact with the end portions in the width direction of the sheets. That is to say, by moving the slide member 221*c* so as to approach the sheets according to the sheet size, it is possible to regulate the position in the width direction of the loaded sheet bundle.

Also, the intermediate plate 221*b* is a plate member that can move so that the sheet bundle approaches a later-described conveyance roller (also referred to as a feeding roller) 222, and is a plate-shaped member constituted by a steel plate or synthetic resin, for example. The intermediate plate 221*b* is arranged downstream in the direction in which the conveyance roller 222 of the fixed plate 221*a* conveys sheets (obliquely downward in FIGS. 11 to 14). Also, the intermediate plate 221*b* is supported rotatably with respect to the apparatus body 211 by fitting projecting portions 221*e* provided on both sides in the width direction thereof (FIGS. 2 to 4) into support holes provided in the apparatus body 211. A rotation support portion is configured by the projecting portions 221*e* and the support holes. In other words, the intermediate plate 221*b* can move using the projecting portions 221*e* as pivot points on the leading end portion side in the sheet feeding direction of the above-described fixed plate 221*a*, and the sheet bundle is biased to the conveyance roller 222 at the leading end portion of the intermediate plate 221*b* so as to form a sheet feed start position. Also, this kind of intermediate plate 221*b* has a range of motion in the upper portion of the apparatus body 211. As shown in FIG. 11, the intermediate plate 221*b* is provided with a wall portion H at a portion facing a later-described separation roller 223. The wall portion H is a contact portion that comes into contact with the leading end portion of the sheet bundle when the sheet bundle is placed on the tray 221. Also, the leading end portion of the intermediate plate 221*b* is configured to move toward the conveyance roller 222 along the contact portion (wall portion H).

Also, as shown in FIGS. 11 to 14, a spring 221*f*, which is a sheet receiving member biasing unit, is arranged between the intermediate plate 221*b* and the apparatus body 211. Also, by elastically bringing the spring 221*f* into contact with a rear surface on opposite side of the front surface of the intermediate plate 221*b* on which the sheets are placed, the intermediate plate 221*b* is biased toward the conveyance roller 222 by the spring 221*f* as shown in FIG. 11. The biasing force of the spring 221*f* is determined by design such that the sheet is sandwiched between a later-described roller 224 provided on the intermediate plate 221*b* and the conveyance roller 222 so that the sheet can be conveyed.

Figure 13:
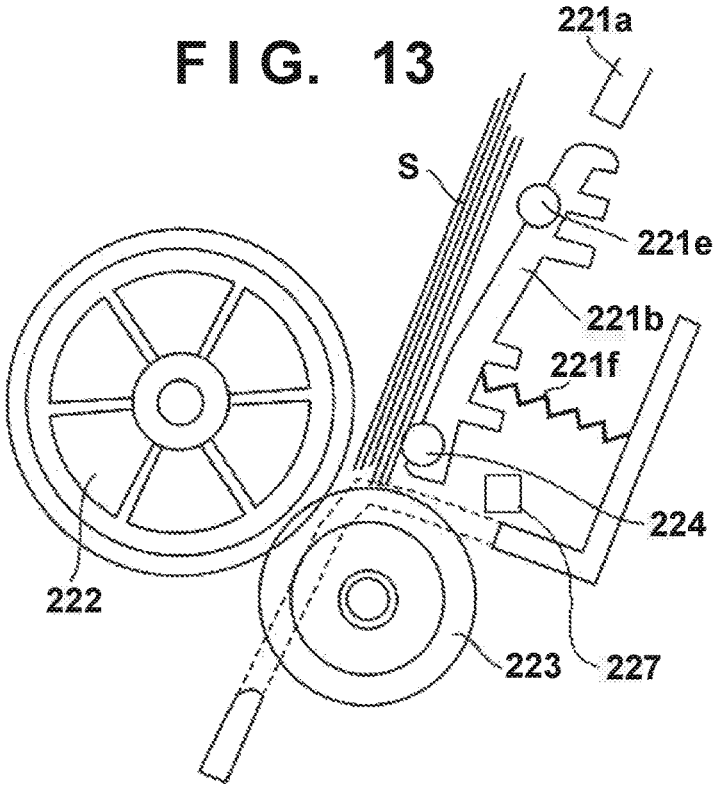
FIG. 13 is a cross-sectional view of a sheet material conveying apparatus.

If a sheet bundle S is mounted in the apparatus, for example, as shown in FIG. 13, it is installed in a state in which the leading end portions of the sheet bundle are not aligned. If the conveyance operation starts in this kind of state, there is a risk that force will not be applied uniformly to the conveyance roller 222, leading to paper jams and oblique traveling. In view of this, it is possible to use the driving unit of the intermediate plate 221*b* (not shown) to cause vibration such that the intermediate plate 221*b* moves closer to or moves away from (approaches or retracts from) the conveyance roller 222, centered about the projecting portions 221*e* fitted into the support holes provided in the apparatus body 211.

Figure 14:
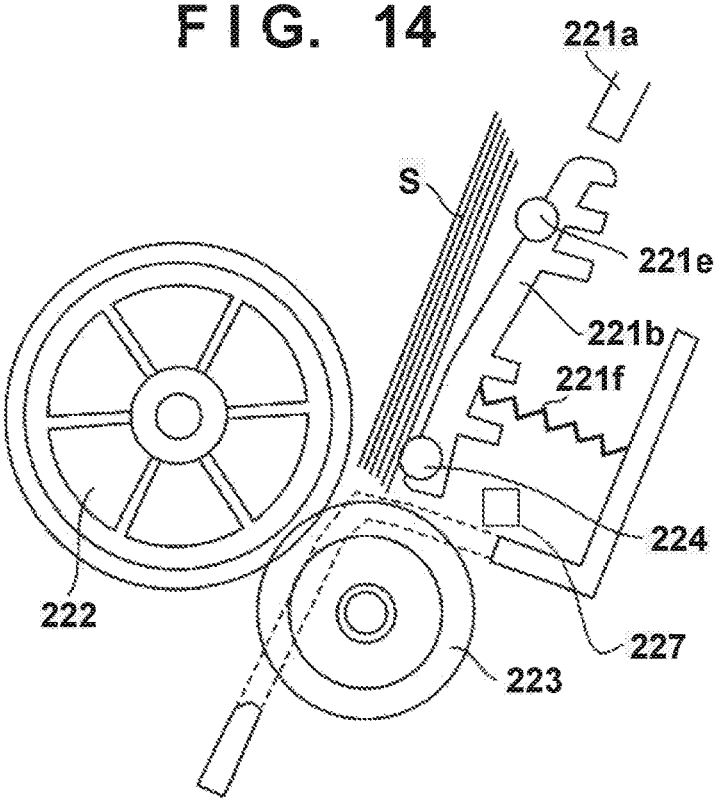
FIG. 14 is a cross-sectional view of a sheet material conveying apparatus.

As shown in FIG. 14, by vibrating the intermediate plate 221*b* at a certain speed when multiple sheets are stacked, the sheet bundle S moves finely up and down in the weight direction and the leading edge of the sheet bundle S comes into contact with the wall portion H and is thereby aligned. Due to the leading ends of the sheet bundle S being aligned using this kind of alignment processing, it is possible to avoid conveyance failure such as jamming of sheets during conveyance, before it happens.

Incidentally, a position detection sensor 227 of the intermediate plate 221*b* can detect the position of the intermediate plate 221*b* and can calculate the number of sheets that have been conveyed since the sheet bundle S was placed based on the detection signal. Also, the position detection sensor 227 can detect the behavior of the intermediate plate 221*b* (position change or amount of change in position). The position detection sensor 227 detects the behavior of the intermediate plate 221*b* when the sheet bundle S is added at some point after the start of sheet conveyance (take-in), and thereby it is possible to detect whether or not there is additional paper supply, or the added sheet amount. Note that if a sheet bundle is added, the intermediate plate 221*b* is a mechanism that is temporarily retracted to the apparatus body 211 side, but due to the fact that orientation variation hardly ever occurs in the sheets during supply due to the existence of the added sheet bundle, adding is completed without interrupting the sheet supply operation.

In the present embodiment, an optical photosensor is used to detect the position of the intermediate plate 221*b* based on the signal detected by the light receiving side. If the position detection sensor 227 of the intermediate plate 221*b* moves close to the intermediate plate 221*b*, the light reception level will increase, and by contrast, if it moves away, the light reception level will decrease.

The detection method is not limited to the above-described method, and as long as it is a method or a sensor according to which the position of the intermediate plate 221*b* can be detected, there is no limit thereto.

The conveyance roller 222 is provided on the cover portion of the apparatus body 211 and is driven so as to rotate by a motor, which is a driving source (not shown). Also, the conveyance roller 222 comes into contact with a sheet on the intermediate plate 221 (sheet receiving member) and the sheet is conveyed toward an information reading unit (e.g., an image reading unit, image forming unit (printing unit), or the like) (not shown) that is arranged downstream in the sheet conveyance direction. Note that in the case of the present embodiment, the conveyance roller 222 is arranged at a position opposite to the central portion in the width direction of the tray 221.

Also, the separation roller 223 is provided at a position opposite to the conveyance roller 222, downstream in the direction in which the sheet is conveyed by the conveyance roller 222 of the tray 221. The separation roller 223 is arranged such that a sheet is interposed between the separation roller 223 and the conveyance roller 222, at a position adjacent to a later-described roller 224 in the direction in which the sheet is conveyed by the conveyance roller 222. Accordingly, in the interest of stability in feeding, it is extremely advantageous to align the sheet bundle before this kind of separation feeding. In other words, as with the present embodiment, it is possible to align the sheet bundle S before the start of feeding by causing the intermediate plate 221*b* to vibrate in the space before the conveyance roller 222. According to this, even if a bundle of sheets of different sizes or a misaligned sheet bundle S is set, the set orientations of the sheets are aligned by merely causing the intermediate plate 221*b* to vibrate before the start of feeding, and it is therefore possible to improve the reliability of the subsequent sheet feeding and conveyance. Also, as with the present embodiment, if a sheet bundle S is added during sheet take-in, it can be detected. For this reason, the alignment operation may be carried out as needed when feeding of the aligned sheet bundle S ends, or when a sheet bundle S is added, for example. This makes it possible to prevent trouble such as damaging of sheets during subsequent sheet take-in or conveyance after sheet take-in. Note that a configuration may be used in which sheet take-in processing is temporarily interrupted when addition of a sheet bundle is detected and alignment processing is carried out when feeding of the aligned sheet bundle ends, or a configuration may be used in which alignment processing is carried out on the aligned sheet bundle as well.

Figure 15:
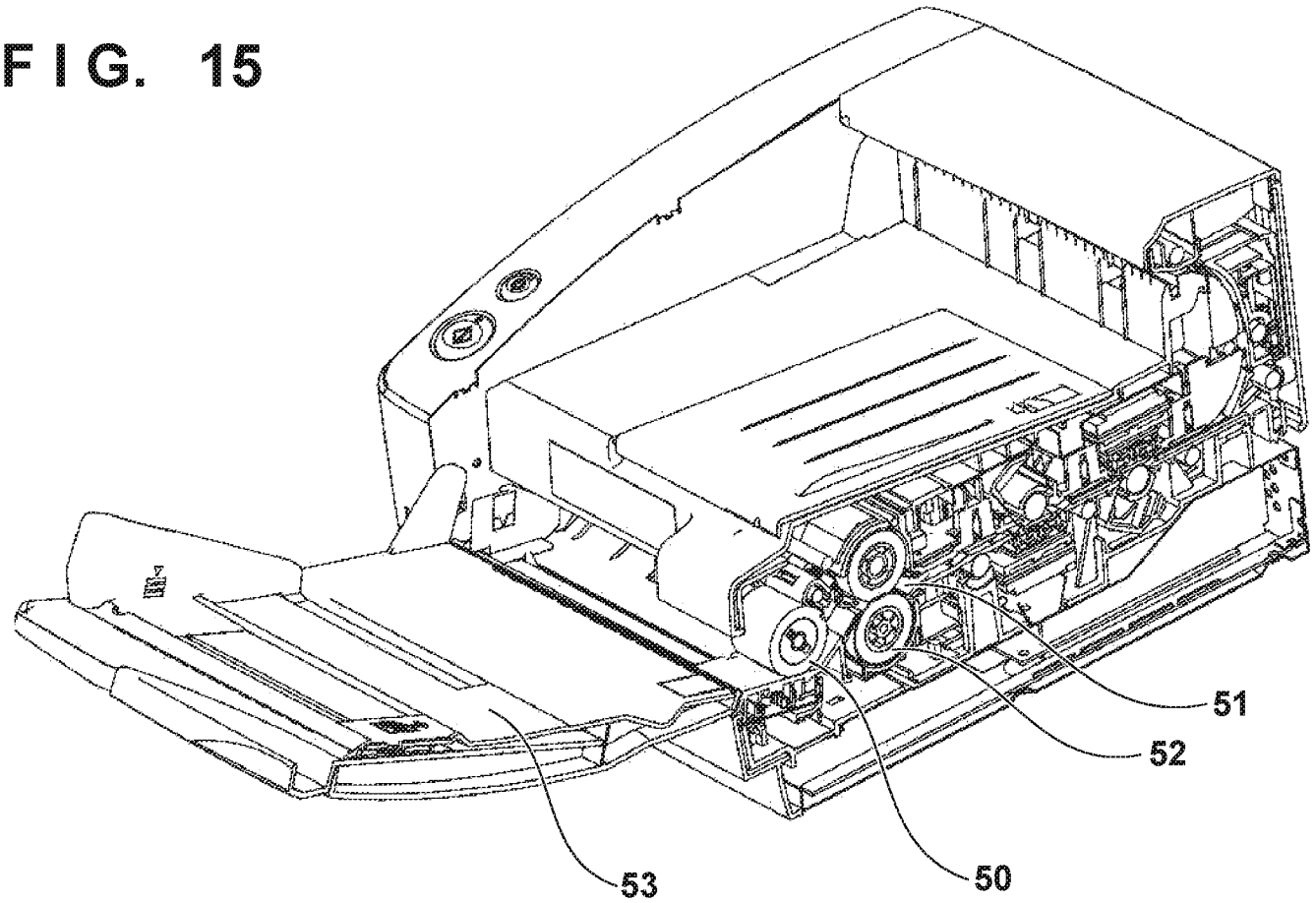
FIG. 15 is a cross-sectional view of a sheet material conveying apparatus.

With the sheet feeding apparatus of the present embodiment, as shown in FIG. 15, the pickup roller 50 carries a sheet bundle stacked on a sheet stacking platform 53 into a conveyance path. Furthermore, the feed roller 51 and the retard roller 52 separate sheets from the upper surface of the sheet bundle and feed them one by one.

Figure 16:
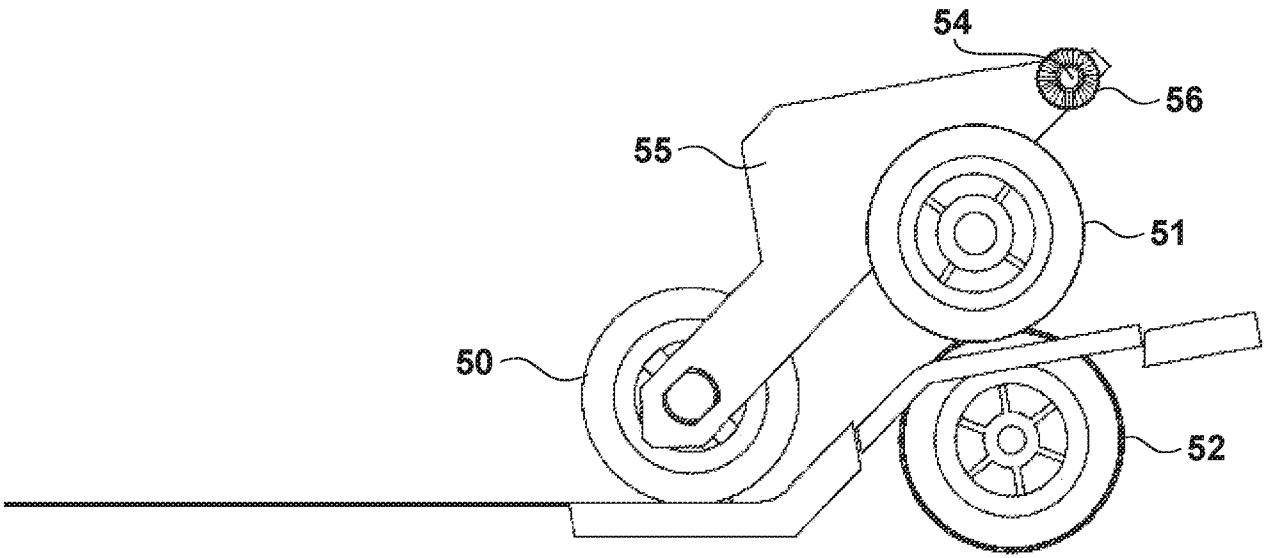
FIG. 16 is a cross-sectional view of a sheet material conveying apparatus.
Figure 17:
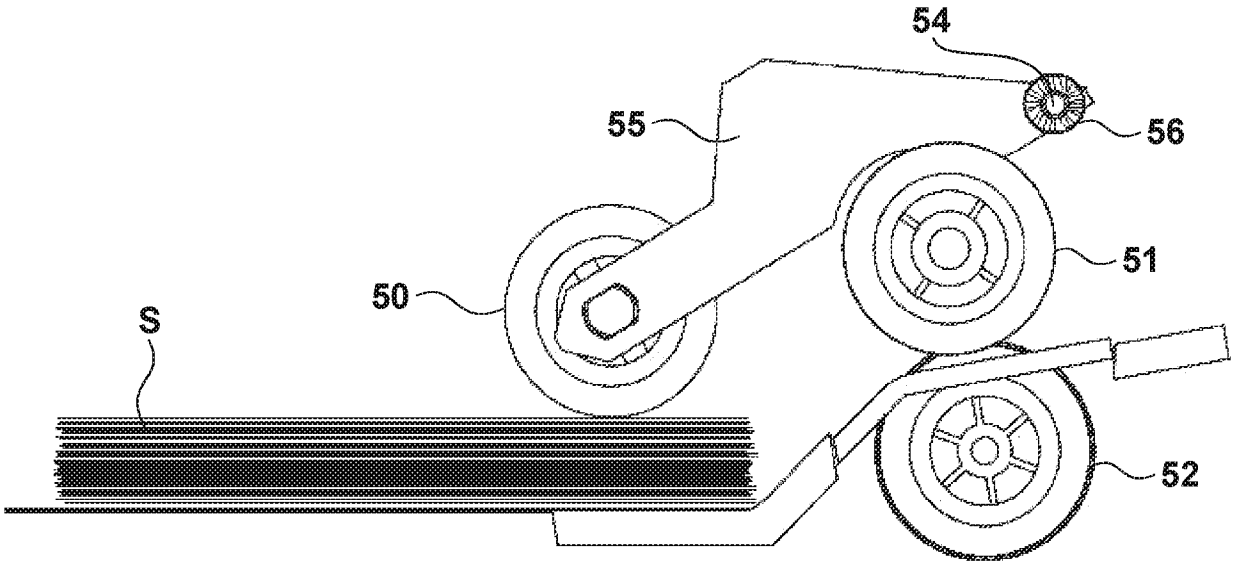
FIG. 17 is a diagram showing a sheet material conveying apparatus.

Also, as shown in FIGS. 16 and 17, the sheet separation mechanism 55 of the present embodiment can move centered about a sliding portion 54. The position of the sheet separation mechanism 55 is changed according to the thickness of the sheet bundle S stacked on the sheet stacking platform 53. A detection mechanism that can detect a rotation position, such as an encoder 56, may be provided on the axis portion of the sliding portion 54. This makes it possible to detect the position of the pickup roller 50 and the position change amount of the pickup roller 50.

In the present embodiment, the position of the pickup roller 50 is detected based on the signal detected by a photointerruptor of the encoder 56. Due to the sheet separation mechanism 55 moving in the up-down direction, a pulse waveform is output from the photointerruptor, and by detecting the pulse waveform, it is possible to detect the displacement of the position of the sheet separation mechanism 55.

When the paper supply operation starts, the pickup roller 50 feeds sheets into the conveyance path in sequence starting from the sheet on the upper surface of the sheet bundle S. After being moved to the conveyance path entrance by the pickup roller 50, sheets are separated one by one and supplied by the feed roller 51 and the retard roller 52.

If a sheet bundle is to be added at some point while the paper supply operation is being performed continuously, the sheet bundle S placed on the sheet stacking platform 53 is slightly lifted up, and sheets are added. At this time, the position of the pickup roller 50 is displaced according to the thickness of the sheet bundle. Also, in order to add a sheet bundle, an operation of lifting the sheet bundle S on the sheet stacking platform 53 upward occurs, and therefore the sheet separation mechanism 55 is lifted temporarily by a significant amount, and thereafter is slightly lowered and becomes stable. If conveyance is continued thereafter, the thickness of the sheet bundle will get thinner little by little as in the above-described embodiment, and the paper supply operation will be continued.

When a sheet bundle is added during the feeding operation, the position of the pickup roller 50 is displaced, whereby the sliding portion 54 rotates in conjunction with the displacement, and a pulse accompanying the rotation is emitted from the encoder 56. By counting the number of pulses, the position of the sheet separation mechanism 55 can be known, and it is possible to obtain the instantaneous change amount by measuring the pulse period. If there is a certain pulse output or more at a certain period during the paper supply operation, it is possible to judge that a sheet has been added.

If it is judged that a sheet has been added during the paper supply operation, the conveyance control unit (not shown) may stop the conveyance operation temporarily after the sheets are added, and after the conveyance operation is stopped temporarily, the sheet vibrating unit can be used to vibrate the sheet bundle so as to align the leading ends thereof.

Note that in the sheet feeding apparatus of the above-described embodiment, it is possible to provide an aligning unit configured to align the sheet bundle S on the sheet stacking platform 53. The aligning unit in this case is, for example, unit configured to vibrate a stopper 40 such as that shown in FIGS. 18 to 20. In this case, inclining the sheet stacking platform 53 with respect to the apparatus body is effective for aligning the leading ends of the sheet bundle.

Figure 18:
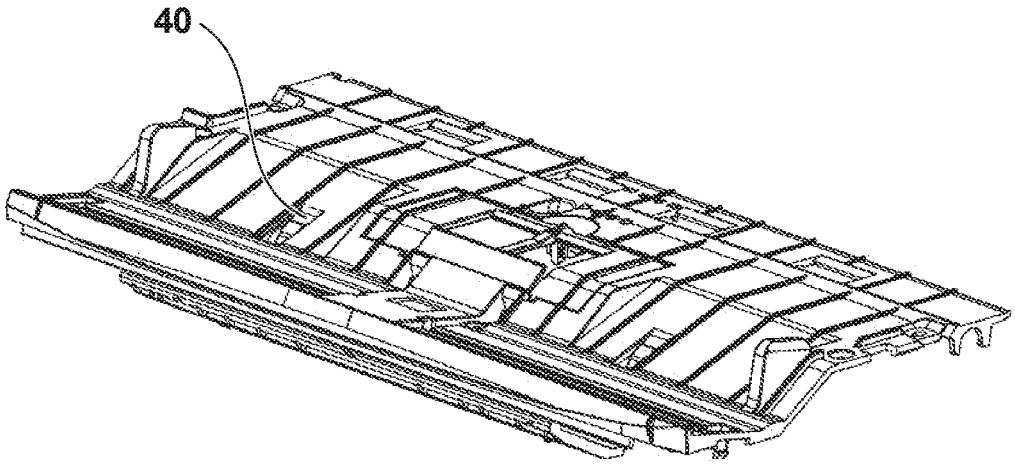
FIG. 18 is a diagram for illustrating a stopper that functions as an aligning unit.
Figure 19:
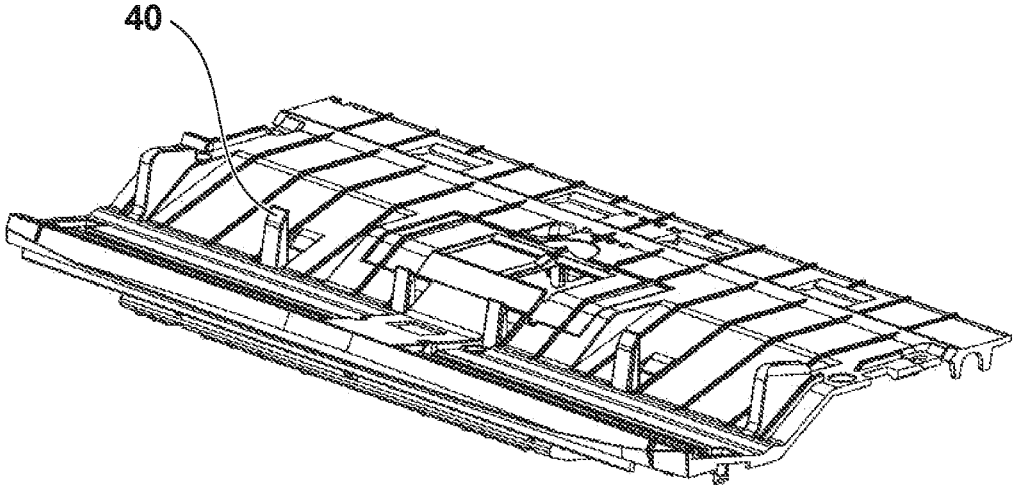
FIG. 19 is a diagram for illustrating a stopper that functions as an aligning unit.
Figure 20:
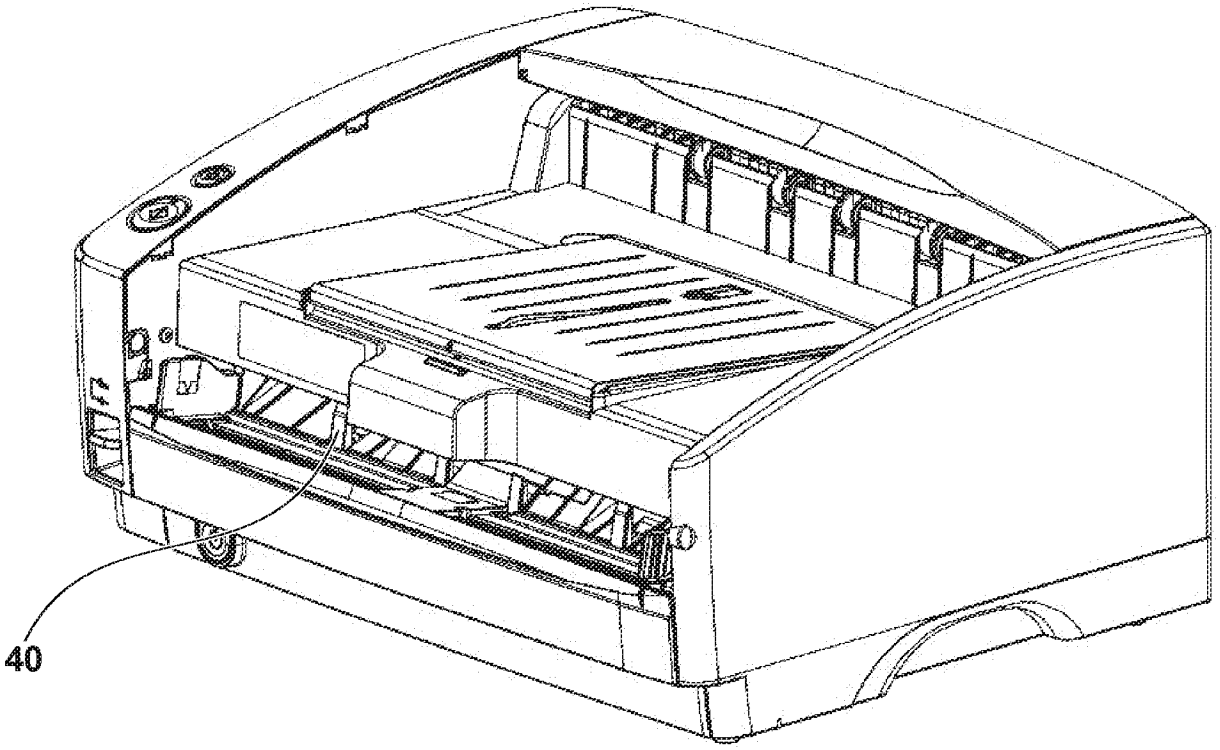
FIG. 20 is a diagram for illustrating a stopper that functions as an aligning unit.

As shown in FIG. 18, the stopper 40 is hidden in the lower inner portion of the sheet stacking platform 53 during the paper supply operation. As shown in FIGS. 19 and 20, when the paper supply operation ends, the stopper 40 protrudes from the conveyance path entrance and restricts the sheet bundle S such that it does not go onto the conveyance path.

The stopper 40 can be driven in the up-down direction by driving unit (not shown), and the stopper 40 is moved up and down at a high speed in a state in which the leading end of the sheet bundle S is touching the stopper 40. This makes it possible to uniformly align the leading ends of the sheet bundle S by moving the sheet bundle S in small and rapid movements.

With the sheet feeding apparatus of the present embodiment, as shown in FIG. 15, the pickup roller 50 carries a sheet bundle stacked on the sheet stacking platform 53 into a conveyance path. Furthermore, the feed roller 51 and the retard roller 52 separate sheets from the upper surface of the sheet bundle and feed them one by one.

Also, as shown in FIGS. 16 and 17, the sheet separation mechanism 55 of the present embodiment can move centered about a sliding portion 54. The position of the sheet separation mechanism 55 is changed according to the thickness of the sheet bundle S stacked on the sheet stacking platform 53. A detection mechanism that can detect a rotation position, such as an encoder 56, may be provided on the axis portion of the sliding portion 54. This makes it possible to detect the position of the pickup roller 50 and the position change amount of the pickup roller 50.

In the present embodiment, the position of the pickup roller 50 is detected based on the signal detected by a photointerruptor of the encoder 56. Due to the sheet separation mechanism 55 moving in the up-down direction, a pulse waveform is output from the photointerruptor, and by detecting the pulse waveform, it is possible to detect the displacement of the position of the sheet separation mechanism 55.

When the paper supply operation starts, the pickup roller 50 feeds sheets into the conveyance path in sequence starting from the sheet on the upper surface of the sheet bundle S. After being moved to the conveyance path entrance by the pickup roller 50, sheets are separated one by one and supplied by the feed roller 51 and the retard roller 52.

If a sheet bundle is to be added at some point while the paper supply operation is being performed continuously, the sheet bundle S placed on the sheet stacking platform 53 is slightly lifted up, and sheets are added. At this time, the position of the pickup roller 50 is displaced according to the thickness of the sheet bundle. Also, in order to add a sheet bundle, an operation of lifting the sheet bundle S on the sheet stacking platform 53 upward occurs, and therefore the sheet separation mechanism 55 is lifted temporarily by a significant amount, and thereafter is slightly lowered and becomes stable. If conveyance is continued thereafter, the thickness of the sheet bundle will get thinner little by little as in the above-described embodiment, and the paper supply operation will be continued. In the case of the above-described configuration, the pickup roller 50 has a role as the sheet take-in unit and a function as a sheet addition detecting unit as well. Note that the amount that was actually added can be indirectly detected by a pickup roller 50 such as that described above. Accordingly, even when sheet take-in is being performed, it is possible to detect only the added amount. For this reason, in the present embodiment, the alignment processing may be executed based on the addition of a sheet. That is to say, the addition of a sheet is detected indirectly using the displacement of the pickup roller, and based on the displacement amount of the pickup roller, alignment processing is possible.

When a sheet bundle is added during the paper supply operation, the position of the pickup roller 50 is displaced, whereby the slide portion 54 rotates in conjunction with the displacement, and a pulse accompanying the rotation is emitted from the encoder 56. By counting the number of pulses, the position of the sheet separation mechanism 55 can be known, and it is possible to obtain the instantaneous change amount by measuring the pulse period. If there is a certain pulse output or more at a certain period during the paper supply operation, it is possible to judge that a sheet has been added.

If it is judged that a sheet has been added during the paper supply operation, the conveyance control unit (not shown) may stop the conveyance operation temporarily after the sheets are added, and after the conveyance operation is stopped temporarily, the sheet vibrating unit can be used to vibrate the sheet bundle so as to align the leading ends thereof. That is to say, here, it is judged whether or not a sheet has been added using the displacement of the pickup roller, and according to that judgment, it is possible to control the subsequent sheet take-in operation.

Note that in the sheet feeding apparatus of the above-described embodiment, it is possible to provide an aligning unit configured to align the sheet bundle S on the sheet stacking platform 53. The aligning unit in this case is, for example, unit configured to vibrate a stopper 40 such as that shown in FIGS. 18 to 20. In this case, inclining the sheet stacking platform 53 with respect to the apparatus body is effective for aligning the leading ends of the sheet bundle.

As shown in FIG. 18, the stopper 40 is hidden in the lower inner portion of the sheet stacking platform 53 during the paper supply operation. As shown in FIGS. 19 and 20, when the paper supply operation ends, the stopper 40 protrudes from the conveyance path entrance and restricts the sheet bundle S such that it does not go onto the conveyance path.

The stopper 40 can be driven in the up-down direction by driving unit (not shown), and the stopper 40 is moved up and down at a high speed in a state in which the leading end of the sheet bundle S is touching the stopper 40. This makes it possible to uniformly align the leading ends of the sheet bundle S by moving the sheet bundle S in small and rapid movements.

Figure 21:
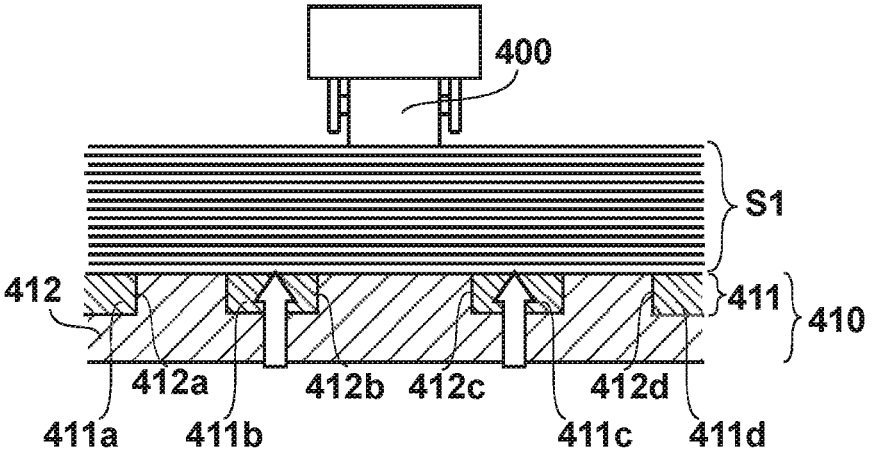
FIG. 21 is a diagram showing a paper supply port of a sheet material conveying apparatus.

FIGS. 21 to 24 show views of the leading end side of the sheet feeding apparatus of the present embodiment as viewed from the rear end side thereof in the paper supply direction of a sheet bundle S1. That is to say, the view is a view of the downstream side of the paper supply port of the sheet feeding apparatus, as viewed from the upstream side in the conveyance direction. As shown in FIGS. 21 to 24, the feeding position is regulated by a sheet stacking tray 410 being raised and lowered with respect to the pickup roller 400. That is to say, as shown in FIG. 21, the sheet stacking tray 410 on which the sheet bundle S1 is stacked is raised so that the sheet bundle S1 is interposed between the sheet stacking tray 410 and the pickup roller 400. By rotating the pickup roller 400 in this state, sheets are separated and taken in one at a time starting from the top position of the sheet bundle S1.

The sheet stacking tray 410 is constituted by an upper tray 411 and a lower tray 412 that can be driven independently by an elevating unit (not shown). The upper-level tray 411 and the lower-level tray 412 are separated in the up-down direction. The shapes thereof are formed so that the lower surface side of the upper-level tray 411 and the upper surface side of the lower-level tray 412 conform to each other. Specifically, multiple concave grooves 412*a* to 412*d* are provided on the upper surface side of the lower-level tray 412. Support portions 411*a* to 411*d* included in the upper-level tray 411 are embedded in the concave grooves 412*a* to 412*d*.

Figure 22:
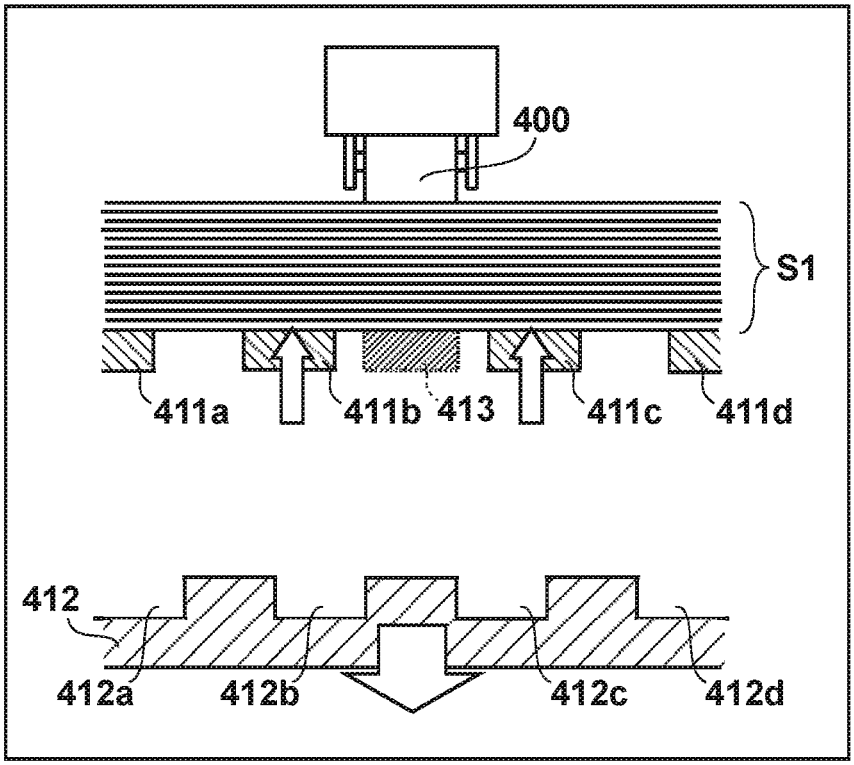
FIG. 22 is a diagram showing a paper supply port of a sheet material conveying apparatus.
Figure 23:
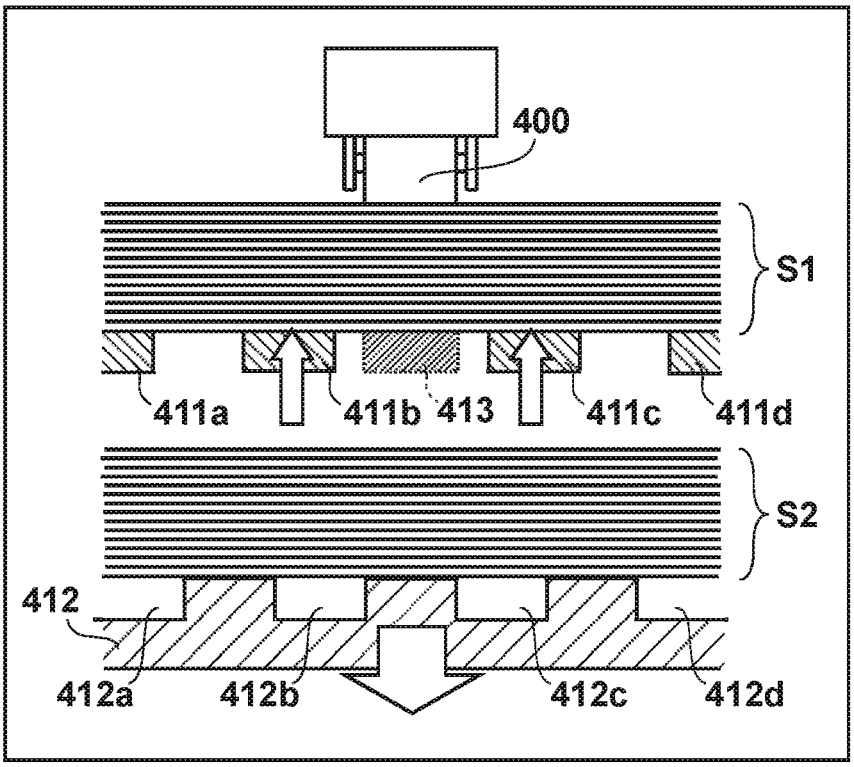
FIG. 23 is a diagram showing a paper supply port of a sheet material conveying apparatus.

As shown in FIG. 22, the lower-level tray 412 may be separated from the upper-level tray 411 while the position of the upper-level tray 411 remains fixed. That is to say, in this state, it is possible to perform feeding while the sheet bundle is held between the pickup roller 400 and the upper-level tray 411. Furthermore, as shown in FIG. 23, the lower-level tray 412 lowers in the direction of retracting from the upper-level tray 411 (downward direction in the drawing), and therefore a sheet bundle S2 can be stacked on the lower-level tray 412.

In this way, the sheet stacking tray 410 is divided into an upper-level tray 411 and a lower-level tray 412, thereby making it possible to form a sheet stacking space for the lower-level tray 412 while performing sheet feeding using the upper-level tray 411. Note that with the sheet feeding apparatus according to the present embodiment, the upper-level tray 411 side is provided with a unit configured to support a sheet with respect to the pressure (biasing) of the pickup roller 400. This is because a sheet needs to be biased toward the pickup roller 400 in order to reliably transmit the feeding power from the pickup roller 400 to the sheet. For this reason, in the present embodiment, at the portion of the upper-level tray 411 facing the pickup roller 400, a sheet support portion 413 is provided such that it can move in and out with respect to the apparatus body side (not shown) (the apparatus body side that supports one end of the sheet stacking tray 410). The sheet support portion 413 is retracted to the apparatus body side during the raising/lowering operation of the lower-level tray 412. This is because if the sheet support portion 413 is not withdrawn, the sheet support portion 413 will interfere and the upper-level tray 411 and the lower-level tray 412 will no longer be integrated. Note that a configuration is used in which the sheet support portion 413 can at least be raised along with the above-described upper-level tray 411.

In this way, the sheet feeding apparatus of the present embodiment uses the sheet stacking tray 410, which is divided into the above-described upper-level tray 411 and lower-level tray 412. In other words, a configuration in which the upper-level tray 411 and the lower-level tray 412 can be raised and lowered as a substantially integrated tray (FIG. 21) is realized, and a configuration in which the upper-level tray 411 and the lower-level tray 412 can be separated from each other so as to be raised and lowered independently (FIG. 22) is also realized. This makes it possible to dramatically increase the sheet stacking capacity without causing an unnecessary increase in the size of the sheet feeding apparatus.

Figure 24:
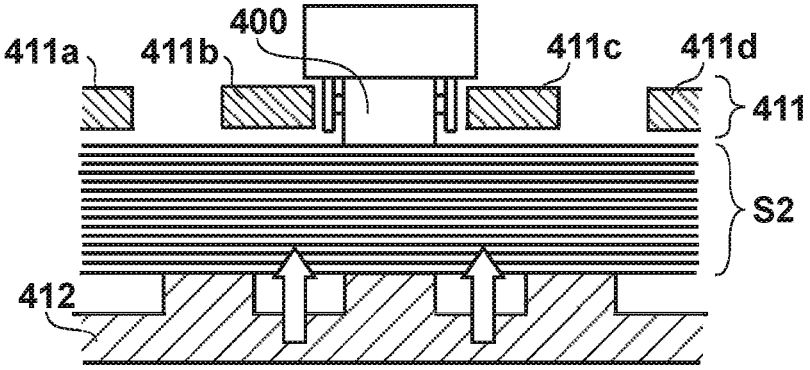
FIG. 24 is a diagram showing a paper supply port of a sheet material conveying apparatus.

Also, with the sheet feeding apparatus of the present embodiment, as shown in FIG. 24, after the feeding of the sheet bundle on the upper-level tray 411 ends, it is possible to raise the upper-level tray 411 so that it stands by in a standby space that does not physically interfere with the pickup roller 400. Furthermore, it is possible to bring the sheet bundle S2, which is stacked in addition on the lower-level tray 412, into contact with the pickup roller 400 by raising the lower-level tray 412. As a result, an operation of feeding sheets from the lower-level tray 412 is realized.

Note that with the sheet feeding apparatus of the above-described embodiment, it is possible to provide an aligning unit configured to align a sheet bundle on the sheet stacking tray 410 (in the case where the upper-level tray 411 and the lower-level tray 412 have integrated structures). It is sufficient that the aligning unit in this case is provided with a configuration that vibrates the sheet stacking tray 410, for example. In this case, inclining the sheet stacking tray 410 with respect to the apparatus body is effective for aligning the leading ends of the sheet bundle.

Also, a configuration may be used in which in the case where the sheet stacking tray 410 is divided, or in other words, after the lower-level tray 412 is lowered from the upper-level tray 411 and an additional sheet bundle S2 has been placed on the lower-level tray 412, only the lower-level tray 412 is selectively vibrated, thereby carrying out the alignment processing for the sheet bundle S2. Accordingly, sheet take-in can be performed on the upper-level tray 411 side, and alignment processing before sheet take-in (preparation operation) can be performed independently on the lower-level tray 412 side.

Note that with the above-described alignment processing, it is possible to use a configuration in which a regulation portion that regulates one or both of the end portions in the width direction of a sheet is provided slideably in a direction perpendicular to the take-in direction of the sheet on the tray face in the upper-level tray 411 and/or the lower-level tray 412, and the regulation portion is used to carry out the alignment processing in the width direction of the sheet bundle as well. Also, if this kind of regulation portion is provided, instead of using a configuration in which the upper-level tray 411 or the lower-level tray 412 is vibrated, it is possible to use a configuration in which the alignment processing is carried out in the width direction of the sheet bundle by moving a slide mechanism (not shown) of the regulating portion in small and rapid movements.

Also, with the present invention, in the case of using the above-described divided tray, it is possible to realize smooth addition by furthermore changing the shape of the upper-level tray as needed as well. Specifically, a region of the upper-level tray that faces the pickup roller is provided with through-holes so that the upper-level tray does not touch the pickup roller. In this case, the through-holes in the upper-level tray pass through the vicinity of the pickup roller when the upper-level tray is raised (brought close to the pickup roller), and accordingly, the upper-level tray is retracted upward of the pickup roller. On the other hand, the upper-level tray is elevatably connected to the apparatus body at both end portions thereof in the width direction, and a pair of movable pieces that sandwich the through-hole is provided more on the inner side in the width direction than the connection portion. The pair of movable pieces are provided slideably between the position for retracting on the connection side and the position facing the pickup roller. Accordingly, the pair of movable pieces move toward the connection portion when the upper-level tray is to be retracted upward of the pickup roller. When a sheet on the upper-level tray is to be taken in by the pickup roller, the pair of movable pieces move to the region facing the pickup roller and a portion for receiving the pressure of the pickup roller is formed. This makes it possible to realize a stable sheet take-in operation. Note that in the above-described case, the upper surface on the pickup roller side of the pair of movable pieces may constitute substantially the same surface as the upper surface on the pickup roller side of the upper-level tray. This makes it possible to realize movement of the pair of movable pieces along the sheet loading surface.

Note that the above-described embodiments have been described mainly with regard to alignment processing. However, the present invention is not limited thereto. For example, when the take-in unit configured to take in the sheet material from the loading platform to the interior of the apparatus body is controlled by the control unit, the control unit may control the operation of the take-in unit by detecting addition of a sheet to the loading platform. For example, if a sheet is added, the control unit may temporarily stop the sheet take-in operation and thereafter resume the take-in operation automatically based on a user operation. In such a case, the control unit may automatically or manually carry out alignment processing such as that in the above-described embodiments before resuming the take-in operation, but it is not necessary to perform the alignment processing. Note that in order to manually instruct control of the take-in unit or control of the aligning unit to the control unit, it is sufficient to provide an operation unit for apparatus operation control in the sheet take-in apparatus or a sheet processing apparatus in which the sheet take-in apparatus is mounted. The control unit starts the control by receiving a user operation from the operation unit. Alternatively, an instruction may be input from a user interface of an information processing apparatus (computer, etc.) connected communicably to the sheet take-in apparatus or the sheet processing apparatus. Specifically, the image processing apparatus displays a control screen on a display or the like and receives a user operation through the control screen, so that instruction information based on that operation is transmitted to the connected sheet take-in apparatus or sheet processing apparatus. Accordingly, the sheet take-in apparatus or sheet processing apparatus may operate. Thus, even if a sheet is added, subsequent sheet take-in or sheet conveyance by means of the sheet take-in unit can be performed favorably. The above-described pickup roller is an example of the sheet take-in unit in this context, but there is no limitation to this, and a sheet feeding roller may be used as the sheet take-in unit, or a sheet separation feeding unit including the separation roller facing the sheet feeding roller may be used as the sheet take-in unit.

The present invention is not limited to the above-described embodiments, and various modifications and changes thereto are possible without straying from the spirit and scope of the present invention. Accordingly, the following claims are attached in order to make the scope of the invention public.

What is claimed is:

1. A sheet material conveyance apparatus comprising:

an apparatus body having a loading platform on which a sheet bundle including a plurality of sheet materials is set;

a separation and conveyance unit that separates a sheet material from the sheet bundle set on the loading platform and conveys the sheet material to a conveyance path provided in the apparatus body; and an alignment unit provided at a loading platform side as compared to a separation and conveyance unit side, the alignment unit aligning the sheet bundle by driving a stopper to be contacted by a leading edge of the sheet bundle set on the loading platform, wherein the apparatus body is horizontally provided, and the loading platform slopes away from the apparatus body.

2. The sheet material conveyance apparatus according to claim 1, further comprising:

a controller that controls driving of the stopper, wherein the controller causes the stopper to move away from an inlet of the conveyance path while the separation and conveyance unit is conveying the sheet material, and the controller continuously drives the stopper at the inlet of the conveyance path while the alignment unit is aligning the sheet bundle.

3. The sheet material conveyance apparatus according to claim 1, wherein the stopper is positioned at an inlet of the conveyance path such that the stopper restricts the sheet material from moving into the conveyance path after the separation and conveyance unit separates the sheet material from the sheet bundle set on the loading platform and conveys the sheet material to the conveyance path.

4. The sheet material conveyance apparatus according to claim 1, further comprising:

a detector that detects an amount of the sheet bundle; and a determiner unit that determines an alignment condition of the alignment unit according to the amount of the sheet bundle detected by the detector.

5. The sheet material conveyance apparatus according to claim 1, further comprising:

a sheet bundle adding detection unit that detects adding of a sheet material to the sheet bundle, wherein the separation and conveyance unit pauses separation and conveyance of the sheet material in a case where the sheet bundle adding detection unit detects adding of a sheet material to the sheet bundle while the separation and conveyance unit is performing the separation and conveyance of the sheet material, and the separation and conveyance unit resumes the separation and conveyance of the sheet material after the alignment unit aligns the sheet bundle.

6. An image reading apparatus comprising:

a sheet material conveyance apparatus according to claim 1; and an image reader that reads an image on a surface of the sheet material separated from the sheet bundle by the separation and conveyance unit.

7. An image forming apparatus comprising:

a sheet material conveyance apparatus according to claim 1; and an image forming unit that forms an image on a surface of the sheet material separated from the sheet bundle by the separation and conveyance unit.

8. A sheet material conveyance apparatus comprising:

an apparatus body having a loading platform on which a sheet bundle including a plurality of sheet materials is set;

a separation and conveyance unit that separates a sheet material from the sheet bundle set on the loading platform and conveys the sheet material to a conveyance path provided in the apparatus body;

an alignment unit provided at a loading platform side as compared to a separation and conveyance unit side, the alignment unit aligning the sheet bundle by driving a stopper to be contacted by a leading edge of the sheet bundle set on the loading platform; and a sheet bundle adding detection unit that detects adding of a sheet material to the sheet bundle, wherein the separation and conveyance unit pauses separation and conveyance of the sheet material in a case where the sheet bundle adding detection unit detects adding of a sheet material to the sheet bundle while the separation and conveyance unit is performing the separation and conveyance of the sheet material, and the separation and conveyance unit resumes the separation and conveyance of the sheet material after the alignment unit aligns the sheet bundle.

9. The sheet material conveyance apparatus according to claim 8, further comprising:

a controller that controls driving of the stopper, wherein the controller causes the stopper to move away from an inlet of the conveyance path while the separation and conveyance unit is conveying the sheet material, and the controller continuously drives the stopper at the inlet of the conveyance path while the alignment unit is aligning the sheet bundle.

10. The sheet material conveyance apparatus according to claim 8, wherein the stopper is positioned at an inlet of the conveyance path such that the stopper restricts the sheet material from moving into the conveyance path after the separation and conveyance unit separates the sheet material from the sheet bundle set on the loading platform and conveys the sheet material to conveyance path.

11. The sheet material conveyance apparatus according to claim 8, further comprising:

a detector that detects an amount of the sheet bundle; and a determiner unit that determines an alignment condition of the alignment unit according to the amount of the sheet bundle detected by the detector.

12. An image reading apparatus comprising:

a sheet material conveyance apparatus according to claim 8; and an image reader that reads an image on a surface of the sheet material separated from the sheet bundle by the separation and conveyance unit.

13. An image forming apparatus comprising:

a sheet material conveyance apparatus according to claim 8; and an image forming unit that forms an image on a surface of the sheet material separated from the sheet bundle by the separation and conveyance unit.

14. A sheet material conveyance apparatus comprising:

an apparatus body which is horizontally provided;

a slope member on which a sheet bundle including a plurality of sheet materials is set, the slope member sloping away from the apparatus body;

a separation and conveyance unit that separates a sheet material from the sheet bundle set on the slope member and conveys the sheet material to a conveyance path provided in the apparatus body; and an alignment unit aligning the sheet bundle by driving a stopper to be contacted by a leading edge of the sheet bundle set on the slope member.

15. The sheet material conveyance apparatus according to claim 14, further comprising:

a controller that controls driving of the stopper, wherein the controller causes the stopper to move away from an inlet of the conveyance path while the separation and conveyance unit is conveying the sheet material, and the controller continuously drives the stopper at the inlet of the conveyance path while the alignment unit is aligning the sheet bundle.

16. The sheet material conveyance apparatus according to claim 14, wherein the stopper is positioned at an inlet of the conveyance path such that the stopper restricts the sheet material from moving into the conveyance path after the separation and conveyance unit separates the sheet material from the sheet bundle set on the slope member and conveys the sheet material to conveyance path.

17. The sheet material conveyance apparatus according to claim 14, further comprising:

a detector that detects an amount of the sheet bundle; and a determiner unit that determines an alignment condition of the alignment unit according to the amount of the sheet bundle detected by the detector.

18. The sheet material conveyance apparatus according to claim 14, further comprising:

a sheet bundle adding detection unit that detects adding of a sheet material to the sheet bundle, wherein the separation and conveyance unit pauses separation and conveyance of the sheet material in a case where the sheet bundle adding detection unit detects adding of a sheet material to the sheet bundle while the separation and conveyance unit is performing the separation and conveyance of the sheet material, and the separation and conveyance unit resumes the separation and conveyance of the sheet material after the alignment unit aligns the sheet bundle.

19. An image reading apparatus comprising:

a sheet material conveyance apparatus according to claim 14; and an image reader that reads an image on a surface of the sheet material separated from the sheet bundle by the separation and conveyance unit.

20. An image forming apparatus comprising:

a sheet material conveyance apparatus according to claim 14; and an image forming unit that forms an image on a surface of the sheet material separated from the sheet bundle by the separation and conveyance unit.

* * * * *